US006007350A

United States Patent [19]

Isshiki

[11] Patent Number: 6,007,350

[45] Date of Patent: Dec. 28, 1999

[54] ELECTRICAL CONNECTION BOX

[75] Inventor: Yoshihiro Isshiki, Yokkaichi, Japan

[73] Assignee: Sumitomo Wiring Systems, Ltd., Japan

[21] Appl. No.: 08/924,237

[22] Filed: Sep. 5, 1997

[30] Foreign Application Priority Data

| | | | |
|---|---|---|---|
| Sep. 12, 1996 | [JP] | Japan | 8-241612 |
| Sep. 12, 1996 | [JP] | Japan | 8-241613 |
| Sep. 12, 1996 | [JP] | Japan | 8-241614 |
| Sep. 12, 1996 | [JP] | Japan | 8-241618 |
| Sep. 12, 1996 | [JP] | Japan | 8-241619 |

[51] Int. Cl.[6] ..... H01R 9/09

[52] U.S. Cl. ..... 439/76.2; 439/949

[58] Field of Search ..... 439/76.2, 621, 439/353, 749

[56] References Cited

U.S. PATENT DOCUMENTS

| | | | |
|---|---|---|---|
| 4,842,534 | 6/1989 | Mobley et al. . | |
| 5,197,906 | 3/1993 | Watanabe et al. . | |
| 5,292,258 | 3/1994 | Sakurai | 439/352 |
| 5,474,475 | 12/1995 | Yamaguchi . | |
| 5,487,677 | 1/1996 | Hoffner | 439/353 |
| 5,795,193 | 8/1998 | Yang | 439/621 |

FOREIGN PATENT DOCUMENTS

| | | |
|---|---|---|
| 0 240 453 | 10/1987 | European Pat. Off. . |
| 0 793 249 | 9/1997 | European Pat. Off. . |
| 39 28 751 | 3/1990 | Germany . |
| WO 94/29145 | 12/1994 | WIPO . |

*Primary Examiner*—Lincoln Donovan
*Assistant Examiner*—J. F. Duverne
*Attorney, Agent, or Firm*—Anthony J. Casella; Gerald E. Hespos

[57] ABSTRACT

A junction box is provided to make any desired part mountable on a part mount portion of the junction box without specializing it for a particular part. There are provided parts, such as an integrated fuse 10, having tabs projecting at equal intervals from a casing 11, a wire connecting connector 30, a diode, and a short-circuiting pin assembly 40. A common mount portion for the part is provided on a casing of an electrical connection box and is formed with tab insertion openings at the same intervals as the tabs of the part. The part is selectively mounted on the common mount portion to connect the tabs inserted through the tab insertion openings with internal circuits of the electrical connection box.

13 Claims, 22 Drawing Sheets

ELECTRICAL CONNECTION BOX

BACKGROUND OF THE INVENTION

1. Field of the Invention

The present invention relates to an electrical connection box comprised of a junction box used for an automotive wiring harness.

2. Description of the Prior Art

In a conventional junction box used for an automotive wiring harness, as shown in FIG. 29, connector receptacles 2, relay receptacles 3, fuse receptacles 4, etc. project from the upper surface of an upper casing 1. These receptacles 2, 3, 4 are specially used for connectors, relays and fuses, respectively. Identified by 5 in FIG. 29 is a lower casing. Between the lower casing 5 and the upper casing 1 are accommodated insulating plates 6, busbars 7 and the like.

Accordingly, only connectors can be fitted into the connector receptacles 2, only relays can be fitted into the relay receptacles 3 and only fuses can be fitted into the fuse receptacles 4. Thus, in the case of changing circuits so as to conform to the type and grade of a vehicle, even if more connectors than the connector receptacles 2 are desired to be connected and less fuses than the fuse receptacles 4 are needed, connector(s) cannot be fitted into the unused fuse receptacle(s) 4. In such a case, the connector(s) need(s) to be connected with the wiring harness outside the junction box, whereas some fuse receptacle(s) 4 and internal circuits provided in correspondence therewith are left unused in the junction box.

Since the receptacles provided in the junction box for parts are specialized, such receptacles cannot respond to a circuit change. Accordingly, the junction box cannot be used efficiently. There is also a problem of an increase of the number of the connectors which need to be used outside the junction box.

The present invention was developed in view of the above problems, and an object thereof is to provide an improved electrical connection box, in particular allowing for an efficient use of the junction box.

SUMMARY OF THE INVENTION

According to the invention, there is provided an electrical connection box comprised of a junction box for an automotive vehicle, on which at least two parts of the group comprising an integrated fuse, a wire connecting connector, a diode, and a short-circuiting pin assembly and like part having tabs projecting from a casing, preferably at equal intervals, are mountable. A common mount portion for the part to be mounted is provided on the electrical connection box and is formed with one or more tab insertion openings arranged for corresponding to the tabs of the part. The part is selectively mounted on the common mount portion to connect the tabs inserted through the tab insertion openings with internal circuits of the electrical connection box.

Thus, the electrical connection box allows receptacles or mount portions for parts to be commonly usable and realizes an efficient use of the junction box by eliminating an unused portion.

According to a preferred embodiment, there is provided an electrical connection box comprised of a junction box for an automotive vehicle, on which an integrated fuse, a wire connecting connector, a diode, a short-circuiting pin assembly and like part having tabs projecting from its casing at equal intervals are mountable. A common mount portion for the part to be mounted is provided on a box of the electrical connection box and is formed with tab insertion openings at the same intervals as the tabs of the part. The part is selectively mounted on the common mount portion to connect the tabs inserted through the tab insertion openings with internal circuits of the electrical connection box.

Since any of the integrated fuse, the diode, the wire connecting connector and the short-circuiting pin assembly can be mounted on the common mount portion for the part provided on the junction box with the above construction, a desired part can be mounted in conformity with a circuit design change. Accordingly, the construction of the junction box can be made denser by eliminating an unused part mount portion.

Preferably, the common mount portion projects from the box of the electrical connection box and the tab insertion openings are formed substantially side by side in the upper surface thereof, and preferably a lock portion having preferably a lock claw projecting therefrom projects from the box of the electrical connection box in the vicinity of the common mount portion and the wire connecting connector is formed with a mating lock means, preferably a lock hole engageable with the lock claw.

Specifically, a rectangular-shaped common mount portion projects from the upper surface of an upper casing of the junction box, and an integrated fuse or a diode is mounted on the upper surface of the common mount portion, such that the tabs projecting from the lower surface of the casing thereof are inserted though the tab insertion openings of the common mount portion. On the other hand, in the case of mounting the wire connecting connector accommodating terminals connected with the ends of wires, an engaging portion having an open lower surface is provided at a portion of the wire connecting connector where terminal receptacles are provided, and the engaging portion is put on the common mount portion. The connector is fixed by engaging the lock claw provided on the junction box with the lock hole formed in the peripheral wall of the engaging portion. At this time, it is preferable to form projection(s) on the peripheral wall of the common mount portion for preventing the connector from getting shaky and bring it/them into pressing contact with the inner surface of the put engaging portion of the connector.

The integrated fuse selectively mountable on the common mount portion similar to the wire connecting connector and the diode is constructed such that at least one conductor including one tab to be connected with a power source and tabs to be connected with loads which are connected via fusible portions with branched portions branched from an extended portion of the tab to be connected with the power source is accommodated in a casing, and the tabs project substantially side by side from preferably the same surface of the casing. With the thus constructed integrated fuse, a power source side circuit can be divided by the number of the branched portions and a plurality of fuses can be constructed using one conductor. Further, since the tabs of the integrated fuse to be connected with the power source and the loads are or may be connected with a power source side internal circuit and load side internal circuits of the electrical connection box, respectively, the respective load side circuits can be connected with the power source side circuit via the fusible portions. Furthermore, since, in the integrated fuse, an amount of permissible current of the tabs to be connected with the loads which are branched from the tab to be connected with the power source can be made smaller, wires having a smaller diameter can be connected with parts as the loads, which in turn prevents the wiring harness from becoming large.

According to the invention, there is further provided an electrical connection box, in particular according to one of the preceding embodiments of the invention, which uses an integrated fuse in which at least one conductor comprising one power source connection tab and/or two or more load connection tabs extending via fusible portions from branched portions branched from the power source connection tab is accommodated in a casing, and wherein an integrated fuse mount portion engageable with the integrated fuse is formed on an outer surface of a box of the electrical connection box and conductors of a power source side circuit and/or load side circuits provided in the electrical connection are connected with the power source connection tab and/or the load connection tabs of the integrated fuse.

According to a preferred embodiment, the power source connection tab and the load connection tabs project substantially side by side from the substantially same surface of the casing, wherein preferably the integrated fuse comprises at least two conductors accommodated in one casing so that at least two power source connection tabs and/or at least four load connection tabs project side by side from the one casing.

Preferably, the electrical connection box comprises a multitude of integrated fuse mount portions which are preferably densely arranged adjacent to each other.

Further preferably, the electrical connection box is comprised of a fuse box having an opening formed preferably in its upper surface, and a multitude of integrated fuses are accommodated substantially side by side through the opening to be branchingly connected with the conductors accommodated in the electrical connection box.

Still further preferably, the conductor accommodated in the electrical connection box is comprised of a busbar comprising fuse connection tabs which are formed preferably by bending and formed with grooves, and the one or more tabs of the integrated fuse are pressed or pressable or insertable or fittable into the grooves to be electrically connected with the busbar.

Still further preferably, the conductor accommodated in the electrical connection box is comprised of a busbar comprising fuse connection tabs which are formed preferably by bending and are to be electrically connected with the tabs of the integrated fuse via intermediate terminals.

Most preferably, the intermediate terminal is formed by a conductive metal plate having a substantially tubular shape provided with tab insertion openings, and comprises a spring portion formed substantially inside each tab insertion opening preferably by bending, wherein one tab is inserted or insertable into one tab insertion opening to be brought into contact with the spring portion while a plurality of tabs are inserted or insertable into the other tab insertion opening(s) to be brought into contact with the other spring portion, so as to establish an electrical branch connection by the intermediate terminal.

According to a further preferred embodiment, two conductors are accommodated in the casing of the integrated fuse such that the power source connection tabs preferably project substantially side by side substantially in the middle of the casing; a busbar connected or connectable with a power source is accommodated in the electrical connection box; and a pair of fuse connection tabs bent from the preferably opposite sides of a base plate of the busbar to project are electrically connected with a pair of power source connection tabs of the integrated fuse.

Preferably, the busbar is made of a conductive metal plate to be accommodated in an electrical connection box. The busbar preferably comprises a base plate arranged in a first, preferably vertical direction, and a tab portion projecting from an end, preferably the upper end of the base plate. The tab portion comprises a first plate continuously extending along the first direction from the end of the base plate. The busbar further comprises a second plate extending in a second direction arranged at an angle different from 0° or 180°, preferably substantially normal with respect to the first direction, and extending preferably in a horizontal direction from the end of the first plate. A third plate extends in the first direction, preferably upwardly from the leading end of the second plate, a fourth plate extending substantially in the second direction substantially opposite from the second plate, and a plurality of tabs project from an end, preferably the upper end of the fourth plate. The second plate, and preferably a leading end thereof, is bent at an angle different from 0° or 180°, preferably at substantially 90° to locate the first plate and the base plate below an arrangement range of the plurality of tabs provided at the fourth plate.

Further preferably, a multitude of pairs of fuse connection tabs substantially opposed to each other at the substantially opposite sides of the base plate of the busbar are provided at predetermined or predeterminable intervals along the length of the base plate so as to be connectable with the power source connection tabs of a multitude of integrated fuses arranged preferably side by side.

Still further preferably, the busbar accommodated in the electrical connection box is provided with a power source connection tab, and a connector accommodating preferably a female terminal connected or connectable with a power source connected wire is fitted or fittable into the electrical connection box, thereby connecting the power source connection tab of the busbar with the connector, preferably by fitting the power source connection tab of the busbar into the female terminal for the electrical connection.

Most preferably, a short-circuiting pin assembly in which a comb-shaped short-circuiting pin is accommodated as a conductor in a casing is used instead of at least one of the multitude of integrated fuses arranged in the electrical connection box to divide a power source circuit without using fuses.

According to a further preferred embodiment, there is provided an electrical connection box which uses an integrated fuse in which at least one conductor comprising one power source connection tab and load connection tabs extending via fusible portions from branched portions branched from an extended portion of the power source connection tab is accommodated in a casing. The power source connection tab and the load connection tabs project side by side from the same surface of the casing. An integrated fuse mount portion engageable with an integrated fuse is formed on an outer surface of a box of the electrical connection box and that conductors of a power source side circuit and load side circuits provided in the electrical connection are connected with the power source connection tab and the load connection tabs of the integrated fuse.

The electrical connection boxes include a junction box, a fuse box, a relay box, and various other electrical connection boxes. Further, internal circuits of the electrical connection box include busbars, a combination of wires and cramping terminals connected with the wires, a FPC (flexible printed circuit), a printed board and various other internal circuits, and also include a circuit construction in which these internal circuits are connected with the tabs of the integrated fuse directly or via intermediate terminals.

In the integrated fuse constructed as above, one conductor is formed with the power source connection tab and a plurality of load connection tabs branched from the extended portion of the power source connection tab and connected therewith via the fusible portions which are projecting from the casing. Thus, the power source side circuit can be divided by the number of the branched portions, and a plurality of fuses can be constructed using one conductor. Further, since the power connection tab and the load connection tabs of the integrated fuse are connected with the power source side internal circuit and the load side internal circuits of the electrical connection box, the respective load side circuits can be connected with the power source side circuit via the fusible portions without taking up a large space. Furthermore, since an amount of permissible current of the load side circuits branched from the power source side circuit can be made smaller in the integrated fuse, wires connected with loads are allowed to have a smaller diameter, thereby preventing a wiring harness from becoming larger.

Accordingly, the fuses can be fractionized because the integrated fuse is used, and the integrated fuse can be connected with the internal circuits of the electrical connection box since it can be directly mounted on the electrical connection box. Accordingly, the load side circuits can be individually connected with the fuses without taking up a large space, with the result that the reliability and safety of an automotive vehicle can be improved.

Particularly, if the electrical connection box is comprised of a fuse box accommodating a multitude of integrated fuses, the fuses can be more efficiently fractionized to be connected with the load side circuits. The fuse box accommodating a multitude of fuses can be made smaller, which contributes to a smaller installation space therefor.

Further, an amount of permissible current of the fuse can be easily made smaller by fractionizing it. In such a case, a load side wire connected with this fuse is allowed to have a smaller diameter. Particularly, in view of a sudden increase in the use of signal circuit wires which are required to have only a small current carrying capacity, the use of thin wires as signal circuit wires prevents a wiring harness from becoming larger and heavier.

Further, if the integrated fuse is constructed such that the power source connection tab and the load connection tabs project side by side from the casing, the connection with the internal circuits of the electrical connection box, particularly with the busbar can be made easily without taking up a large space. In other words, the tabs of the busbar can be connected with the tabs of the fuses via the intermediate terminals. Further, in the case that the busbar has cramping tabs, the tabs of the fuses are simply pressed into the grooves of the cramping tabs for the connection.

For example, the integrated fuse preferably comprises at least two conductors accommodated in one casing so that at least two power source connection tabs and at least four load connection tabs project side by side from the one casing. It should be noted that the integrated fuse may comprise one power source connection tab and two or more load connection tabs branched from the power source connection tab.

If the power source side circuit is branched by one conductor, a multitude of small fuses are provided and a plurality of such conductors are used as above, a multitude of fuses connected with the power source side circuit can be accommodated in one integrated fuse. Thus, the circuit can be fractionized without taking up a large space.

Preferably, the electrical connection box is provided with a multitude of integrated fuse mount portions which are densely arranged adjacent to each other. If the integrated fuse mount portions are provided adjacent to each other, the connection with the internal circuits of the electrical connection box can be made in a rational manner.

Preferably, the electrical connection box is comprised of a fuse box having an opening formed in its upper surface, and a multitude of integrated fuses are accommodated side by side through the opening to be branchingly connected with the conductors accommodated in the electrical connection box.

If the electrical connection box is comprised of a fuse box for the integrated fuses, a multitude of integrated fuses can be efficiently accommodated in the small fuse box and the power source side circuit and the load side circuits inside the box can be efficiently constructed.

The conductor accommodated in the electrical connection box is preferably comprised of a busbar comprising fuse connection tabs which are formed by bending and formed with grooves, and the tabs of the integrated fuse are pressed into the grooves to be electrically connected with the busbar. Alternatively and/or further, the fuse connection tabs formed by bending the busbar may be electrically connected with the tabs of the integrated fuse via intermediate terminals.

If the power source connection tab and the load connection tabs of the integrated fuse are connected with the tabs of the busbar accommodated in the electrical connection box as above, a connecting operation can be more easily performed as compared with a case where the tabs of the fuses are connected with cramping terminals connected with ends of wires, and the tabs of the fuses can be connected with the power source side circuit and the load side circuits without taking up a large space. Particularly, if the tabs formed on the busbar are cramping tabs, they can be directly connected with the tabs of the fuses without using the intermediate terminals.

Preferably, two conductors are accommodated in the casing of the integrated fuse such that the power source connection tabs project side by side in the middle of the casing; a busbar connected with a power source is accommodated in the electrical connection box; and a pair of fuse connection tabs bent from the opposite sides of a base plate of the busbar to project are electrically connected with a pair of power source connection tabs of the integrated fuse.

If the power source connection tabs of the two conductors provided in the integrated fuse are arranged adjacent to each other, they can be connected with a pair of tabs projecting from the opposite sides of the base plate of the busbar of the power source side circuit. Thus, the power source side circuit and a plurality of power source connection tabs of the fuses can be connected by a simplest construction in a smallest space.

Preferably, a multitude of pairs of fuse connection tabs opposed to each other at the opposite sides of the base plate of the busbar are provided at specified intervals along the length of the base plate so as to be connectable with the power source connection tabs of a multitude of integrated fuses arranged side by side.

If the busbar is configured such, when a multitude of integrated fuses are accommodated side by side, the power source side circuit can be efficiently divided by providing one busbar for the power source connection tabs of the integrated fuses.

Preferably, the busbar accommodated in the electrical connection box is provided with a power source connection tab, and a connector accommodating a female terminal connected with a power source connected wire is fitted into the electrical connection box, thereby fitting the power source connection tab of the busbar into the female terminal for the electrical connection.

If the internal circuit of the electrical connection box to be connected with the power source connection tab of the fuse is constructed by a busbar and the busbar and the power source connected wire are connected by engaging the tab provided at an end of the busbar with the cramping terminal mounted on an end of the power source connected wire inside the connector which is fitted into the above electrical connection box, such a connection can be made in one operation, improving an assembling operability.

Further preferably, a short-circuiting pin assembly in which a comb-shaped short-circuiting pin is accommodated as a conductor in a casing is used instead of at least one of the multitude of integrated fuses arranged in the electrical connection box to divide a power source circuit without using fuses.

According to the invention, there is further provided an electrical connection box, in particular according to one of the preceding embodiments of the invention, which connects tabs projecting at small intervals from a casing of an integrated fuse, a wire connecting connector, a diode, a short-circuiting pin assembly, or like part to be mounted thereon with one or more busbars accommodated therein. A tab, formed by bending an end of the busbar, is formed with at least one press groove, so that a tab of the part can be pressed into the press groove for the connection. The busbar is bent to form a projecting portion, preferably an upward projecting U-shape portion, which is formed in a leading end wall thereof with a substantially transverse groove extending between substantially opposite side walls thereof and in the side walls thereof with a pair of press grooves, extending preferably substantially in the longitudinal direction of the side walls, the adjacent tabs of the part being pressed or pressable or fittable into the pair of press grooves to establish an electrical connection.

According to a further preferred embodiment, one side portion of the leading end wall of the bent portion of the busbar with respect to the substantially transverse groove is cut away, so that the ends toward the leading end wall of the side walls at the one side of the press grooves are not connected by the leading end wall so as to be movable.

Preferably, a portion of the leading end wall of the busbar at the other side of the substantially transverse groove where the substantially opposite side walls are connected has a larger width than that of a cut-away portion thereof.

Most preferably, the tabs to be connected with the same circuit formed by one busbar are caused to project from the casing substantially adjacent to each other.

According to still a further preferred embodiment of the invention, there is provided an electrical connection box which connects tabs projecting at small intervals from a casing of an integrated fuse, a wire connecting connector, a diode, a short-circuiting pin assembly, or like part to be mounted thereon with busbars accommodated therein. A tab, formed by bending an end of the busbar is formed with a press groove, so that the tab of the part can be pressed into the press groove for the connection. The tabs that are to be connected with the same circuit formed by one busbar are caused to project from the casing adjacent to each other. The busbar is bent to form an upwardly projecting U-shape portion which is formed in a horizontal leading end wall thereof with a transverse groove extending between opposite vertical side walls thereof and in the vertical side walls thereof with a pair of vertical extending press grooves. The adjacent tabs of the part are pressed into the pair of press grooves to establish an electrical connection.

If the press grooves are provided in the tabs formed by bending the busbar as above, the part can be directly connected with the busbar without using intermediate terminals by pressing the tabs of the part into the press grooves. Accordingly, the part can be provided with the tabs projecting at small intervals, thereby being allowed to have a smaller size. Further, in the case that the tabs need to be connected with the same circuit formed by one busbar, the tabs of the part can be efficiently connected with the same circuit by providing the busbar with the U-shaped bent portion and forming the press grooves in the opposite vertical side walls thereof.

For example, in the case that two tabs of the integrated fuse need to be connected with a power source, these tabs may be arranged side by side in the middle and pressed into the press grooves formed on the opposite sides of the U-shaped bent portion of the busbar. The extended portions of the power source connection tabs of the integrated fuse are branched, and load connection tabs are provided at these branched portions via fusible portions. If these load connection tabs are arranged at the opposite sides of the power source connection tabs and are connected with the other tabs of the busbars formed with the press grooves, the respective tabs of the integrated fuse can be connected with the busbars in a small space.

As is clear from the above description, the tabs projecting from the casing of the part at small intervals can be connected with the busbars accommodated in the electrical connection box without using intermediate terminals. Particularly, the connection of the tabs of the part with the tabs of the same busbar which has been difficult without intermediate terminals can be made possible by providing the busbar with the U-shaped bent portion and forming the press grooves in the opposite vertical side walls thereof.

Since the part and the busbars can be connected without using the intermediate terminals, the number of elements can be reduced and the number of operations for the assembly of the electrical connection box can be reduced. As a result, production costs can be reduced. Further, since a space for the intermediate terminals is not necessary, the electrical connection box can be made smaller.

Preferably, one side portion of the horizontal leading end wall of the bent portion of the busbar with respect to the transverse groove is cut away, so that the upper ends of the vertical side walls at the one side of the press grooves are not connected by the horizontal leading end wall so as to be movable.

By making the opposite vertical side walls formed with the press grooves movable as above, the deformation and/or displacement of the tabs of the part along their thickness direction or a tolerance of their thickness can be easily compensated for.

If the one side portion of horizontal leading end wall is cut away, strength is reduced. Accordingly, a portion of the horizontal leading end wall of the busbar at the other side of the transverse groove where the opposite vertical side walls are connected preferably has a larger width than a cut-away portion thereof.

According to a second aspect of the invention, there is provided an intermediate terminal formed by a conductive metal plate having a substantially tubular shape provided with tab insertion openings, comprising a spring portion formed substantially inside each tab insertion opening preferably by bending, wherein one tab is inserted or insertable into one tab insertion opening to be brought into contact with the spring portion while a plurality of tabs are inserted or insertable into the other tab insertion opening(s) to be brought into contact with the other spring portion, so as to establish an electrical branch connection by the intermediate terminal.

According to a preferred embodiment, the spring portion provided at one end of the intermediate terminal is divided into a plurality of substantially narrow spring pieces with which the plurality of tabs are or can be brought into contact, respectively and wherein the spring portion provided at the other end thereof is one substantially wide spring portion with which one substantially wide tab is or can be brought into contact.

Preferably, the spring portions provided at the opposite ends of the intermediate terminal are divided into a plurality of substantially narrow spring pieces, and wherein one substantially wide tab is or can be brought into contact with the plurality of spring pieces or one substantially narrow tab is or can be brought into contact with one spring piece at the end where one tab is inserted or insertable or fittable.

Most preferably, the intermediate terminal is formed by bending the conductive metal plate to have a substantially tubular shape, wherein the tab insertion openings are provided at its opposite ends.

According to the second aspect of the invention, there is provided a branch connection construction for connecting tabs projecting from a casing of an integrated fuse, a wire connecting connector, a diode, a short-circuiting pin assembly, or like part to be mounted on an electrical connection box with busbars accommodated in the electrical connection box via intermediate terminals according to the second aspect of the invention, wherein a plurality of tabs projecting from the part are inserted into at least one tab insertion opening of the intermediate terminal to be brought into contact with the spring portion or spring pieces and at least one tab formed on the busbar accommodated in the electrical connection box preferably by bending is inserted or insertable into the other tab insertion opening of the intermediate terminal to be brought into contact with the spring portion or spring pieces.

According to a preferred embodiment, the busbar is a power source circuit which is branchingly connected with circuits of the part via the intermediate terminal.

Preferably, the at least one tab of the busbar is bent to extend at an angle different from 0° or 180°, preferably substantially normal from a base plate of the busbar; the base plate is arranged on an insulating plate formed preferably with a rib; the intermediate terminal is arranged on a surface of the insulating plate, preferably of the rib; and wherein preferably a space below the intermediate terminal where no tab projects from the busbar is used or usable as a space to arrange a different busbar.

According to still a further preferred embodiment, there is provided an intermediate terminal formed by bending a conductive metal plate to have a tubular shape provided with tab insertion openings at its opposite ends, comprising a spring portion formed inside each tab insertion opening by bending, one tab being inserted into one tab insertion opening to be brought into contact with the spring portion while a plurality of tabs being inserted into the other tab insertion opening to be brought into contact with the spring portion, so as to establish an electrical branch connection by the intermediate terminal.

With the above construction, for example, in the case that the power source circuit is divided into a plurality of circuits, the power source circuit needs not be provided with as many tabs as the divided power source circuits. In other words, the power source circuit can be divided into a plurality of circuits using one tab and one intermediate terminal.

As is clear from the above description, in the case that the tabs projecting substantially side by side from the casing of the part are connected with conductive tabs of the busbar or the like accommodated in the electrical connection box via the intermediate terminals, one power source side tab is branchingly connected with a plurality of tabs of the part via one intermediate terminal.

Accordingly, as compared with the prior art, the number of intermediate terminals used can be reduced, thereby reducing the number of elements. Further, the number of operations for the assembly can be reduced, leading to reduced production costs.

Specifically, the spring portion provided at one end of the intermediate terminal is divided into a plurality of narrow spring pieces with which the plurality of tabs are brought into contact, respectively and the spring portion provided at the other end thereof is one wide spring portion with which one wide tab is brought into contact.

In other words, in the case that a large current needs to be distributed, one wide tab is brought into contact with the wide spring portion of the intermediate terminal, whereas the part to which the current is distributed has narrow tabs which are brought into contact with the narrow spring pieces.

Alternatively, the spring portions provided at the opposite ends of the intermediate terminal are divided into a plurality of narrow spring pieces, and one wide tab is brought into contact with the plurality of spring pieces or one narrow tab is brought into contact with one spring piece at the end where one tab is inserted.

If the intermediate terminal is vertically symmetrically shaped by providing a plurality of narrow spring pieces at the opposite ends thereof, power source side tab may be a narrow tab which is brought into contact with one spring piece in the case of a small current, while being a wide tab which is brought into contact with the plurality of narrow spring pieces in the case of a large current. Thus, this intermediate terminal can respond to a current amount.

Thus, the wide tab is or can be used in the case of distributing a large current, and the narrow tab is or can be used in the case of distributing a small current. Thus, one intermediate terminal can be properly used for both cases.

According to a further embodiment of the second aspect of the invention, there is provided a branch connection construction using the intermediate terminals, and specifically is directed to a branch connection construction for connecting tabs projecting from a casing of an integrated fuse, a wire connecting connector, a diode, a short-circuiting pin assembly, or like part to be mounted on an electrical connection box with busbars accommodated in the electrical connection box via intermediate terminals according to an the second aspect of the invention, wherein a plurality of tabs projecting from the part are inserted into one tab insertion opening of the intermediate terminal to be brought into contact with the spring portion or spring pieces and one tab formed on the busbar accommodated in the electrical connection box by bending is inserted into the other tab insertion opening of the intermediate terminal to be brought into contact with the spring portion or spring pieces.

Preferably, the busbar is a power source circuit which is branchingly connected with circuits of the part via the intermediate terminal.

With the above construction, the number of tabs branched from the busbar accommodated in the electrical connection box such as a junction box as well as the number of the intermediate terminals can be reduced.

Preferably, the tab of the busbar is bent to extend upward from a base plate of the busbar; the base plate is arranged on an insulating plate formed with a rib; the intermediate terminal is arranged on the upper surface of the rib; and a space below the intermediate terminal where no tab projects from the busbar is used as a space to arrange a different busbar.

If the intermediate terminal is arranged on the rib of the insulating plate to raise the intermediate terminal arranging surface to a higher position than the busbar arranging surface, a different busbar can be arranged where no tab projects from the busbar. Accordingly, the inner space of the electrical connection box can be effectively utilized, enabling a high density arrangement.

In other words, if the busbar provided in the electrical connection box has a narrow tab and the intermediate terminal is arranged on the rib of the insulating plate to provide an empty space below the intermediate terminal, a different busbar can be arranged in this space, thereby improving a degree of freedom of circuit construction.

According to a third aspect of the invention, there is provided a busbar made of a conductive metal plate and to be accommodated in an electrical connection box. The busbar comprises a base plate arranged in a first, preferably vertical direction, and a tab portion projecting from an end, preferably the upper end of the base plate. The tab portion comprises a first plate continuously extending along the first direction from the end of the base plate. A second plate extends in a second direction arranged at an angle different from 0° or 180°, preferably substantially normal with respect to the first direction, extending preferably in a horizontal direction from the end of the first plate. A third plate extends in the first direction, preferably upwardly from the leading end of the second plate. A fourth plate substantially extends in the second direction substantially opposite from the second plate, and a plurality of tabs projecting from an end, preferably the upper end of the fourth plate. The second plate, preferably a leading end thereof, is bent at an angle different from 0° or 180°, preferably at substantially 90° to locate the first plate and the base plate below an arrangement range of the plurality of tabs provided at the fourth plate.

According to a preferred embodiment, the first plate is bent at an angle different from 0° or 180°, preferably at substantially 90° and the base plate is arranged to extend substantially in the second direction below the arrangement range of the plurality of tabs provided at the ends of the fourth plate.

Preferably, the base plate bent to extend in the second direction is partly embossed to form projecting reinforcing ribs.

According to the third aspect of the invention, there is further provided a branch connection construction in which at least four tabs project substantially side by side at small intervals from a casing of an integrated fuse, a wire connecting connector, a diode, a short-circuiting pin assembly, or like part to be mounted on an electrical connection box and a plurality of tabs, preferably middle tabs of the at least four tabs are connected with the busbar accommodated according to the third aspect of the invention.

According to a preferred embodiment, the busbar is comprised in a power source circuit and a power is distributed to the part via the busbar.

Preferably, the middle tabs of the part are connected with tabs of the busbar via intermediate terminals, and wherein the tabs of the part adjacent to and at the opposite sides of the middle tabs are connected with cramping terminals connected with ends of wires.

According to a further preferred embodiment, there is provided a busbar made of a conductive metal plate and to be accommodated in an electrical connection box. The busbar comprises a base plate arranged in a vertical direction, and a tab portion projecting from the upper end of the base plate. The tab portion comprises a first vertical plate continuously and upwardly extending from the upper end of the base plate. A first horizontal plate extends in a horizontal direction from the upper end of the first vertical plate. A second vertical plate extends upwardly from the leading end of the first horizontal plate. A second horizontal plate extends in a horizontal direction opposite from the first horizontal plate, and a plurality of tabs project from the upper end of the second horizontal plate. The leading end of the first horizontal plate is bent at 90° to locate the first vertical plate and the base plate below an arrangement range of the plurality of tabs provided at the upper end of the second horizontal plate.

By configuring the busbar as above, the base plate arranged in the vertical direction can be located within the arrangement range of the plurality of tabs without projecting outward therefrom.

As is clear from the above description, the configuration of the busbar is improved such that the base plate thereof does not project from the arrangement range of the tabs. Accordingly, a plurality of middle ones of the tabs projecting side by side at small intervals from the casing of the part can be connected with the tabs provided on the busbar accommodated in the electrical connection box. Thus, the power source circuit can be divided by connecting the narrowly spaced and juxtaposed tabs of the part with the busbar arranged in the electrical connection box.

As a result, unlike the prior art, it is not necessary to use wires corrected with cramping terminals instead of the busbar. Accordingly, the number of such wires can be reduced and the need for the connection of the wires with the cramping terminals can be eliminated. Thus, production costs can be reduced by reducing the number of elements and a necessary labor.

Preferably, the first vertical plate is bent at 90° and the base plate is arranged to extend in a horizontal direction below the arrangement range of the plurality of tabs provided at the upper ends of the second horizontal plate.

By configuring the busbar such, the height of the second horizontal plate can be increased by the reduction of the height of the busbar, thereby improving support strength for the tabs. This reduces a likelihood that the tabs are deformed by an engaging force which acts during the engagement with the fuse. Further preferably, the base plate bent to extend in the horizontal direction is partly embossed to form upward projecting reinforcing ribs. By configuring the busbar such, the support strength for the tabs can be further increased.

According to a further preferred embodiment, there is provided a branch connection construction in which at least four tabs project side by side at small intervals from a casing of an integrated fuse, a wire connecting connector, a diode, a short-circuiting pin assembly, or like part to be mounted on an electrical connection box and a plurality of middle tabs of the at least four tabs are connected with the busbar accommodated according to an embodiment of the invention.

Since the base plate does not project outward even if the plurality of tabs project from the busbar as described above, the tabs of the busbar can be connected with the middle tabs projecting at small intervals from the part. This obviates the need for the connection of wire connected cramping terminals with the middle tabs of the part, thereby reducing a labor required for the assembly.

Preferably, the busbar is a power source circuit and a power is distributed to the part via the busbar. Further preferably, the middle tabs of the part are connected with tabs of the busbar via intermediate terminals, and the tabs of the part adjacent to and at the opposite sides of the middle tabs are connected with cramping terminals connected with ends of wires.

In this way, the power source circuit can be easily divided by connecting the middle tabs projecting at small intervals from the part with the tabs of the busbar as the power source circuit. Further, by arranging the cramping terminals connected with the ends of the wires connected with loads at the opposite outer sides, the wires can be more conveniently handled.

These and other objects, features and advantages of the present invention will become more apparent upon a reading of the following detailed description and accompanying drawings.

BRIEF DESCRIPTION OF THE DRAWINGS

FIG. 1(A) is a plan view, FIG. 1(B) is a section along 1(B)—1(B) of FIG. 1(A) and FIG. 1(C) is a section along 1(C)—1(C) of FIG. 1(A).

FIGS. 2(A) to 2(C) show an integrated fuse, wherein FIG. 2(A) is a plan view, FIG. 2(B) is a front view and FIG. 2(C) is a front view with a front side portion of a casing taken away.

FIGS. 4(A) to 4(C) show a wire connecting connector to be mounted on the common mount portion, wherein FIGS. 4(A) is a front view, FIG. 4(B) is a bottom view, and FIG. 4(C) is a side view partly in section.

FIGS. 19(A) and 19(B) show an intermediate terminal according to the first embodiment of the second aspect of the invention, wherein FIG. 19(A) is a perspective view when viewed from one side and FIG. 19(B) is a perspective view partly cut away when viewed from the other side.

FIGS. 22(A) to 22(C) show an intermediate terminal according to a second embodiment of the second aspect of the invention, wherein FIG. 22(A) is a perspective view, FIG. 22(B) is a side view and FIG. 22(C) is a section along 22(C)—22(C) of FIG. 22(B).

FIG. 24(A) and 24(B) show a first embodiment of a third aspect of the invention, wherein FIG. 24(A) is an exploded view and FIG. 24(B) is a bottom view of a fuse mount portion, FIGS. 25(A) to 25(C) show a busbar according to the first embodiment, wherein FIG. 25(A) is a front view, FIG. 25(B) is a plan view and FIG. 25(C) is a diagram showing the formation of the busbar.

FIGS. 27(A) and 27(B) show a busbar according to a second embodiment of the third aspect, wherein FIG. 27(A) is a front view and FIG. 27(B) is a diagram showing the formation of the busbar.

FIGS. 28(A) and 28(B) show a busbar according to a third embodiment of the third aspect, wherein FIG. 28(A) is a front view and FIG. 28(B) is a diagram showing the formation of the busbar.

DETAILED DESCRIPTION OF THE PREFERRED EMBODIMENTS

Hereafter, embodiments of the invention is described with reference to the accompanying drawings, wherein same or similar elements are denoted with same or similar reference signs.

Figure 1A:
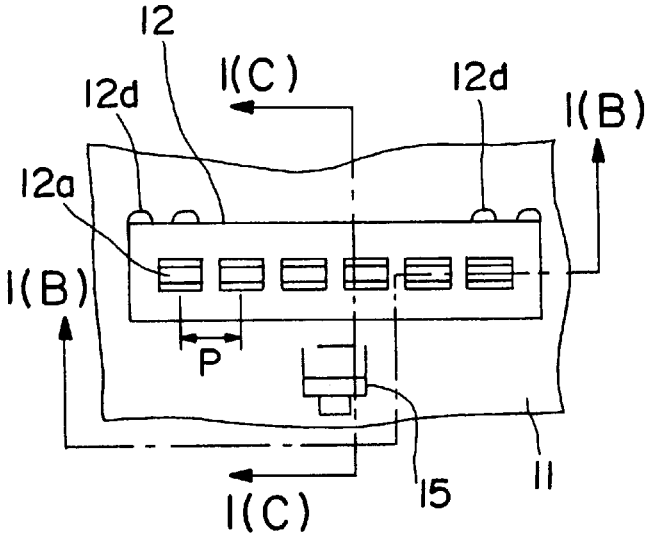
FIGS. 1(A) to 1(C) show a part of a junction box according to one embodiment of the invention, where
Figure 1C:
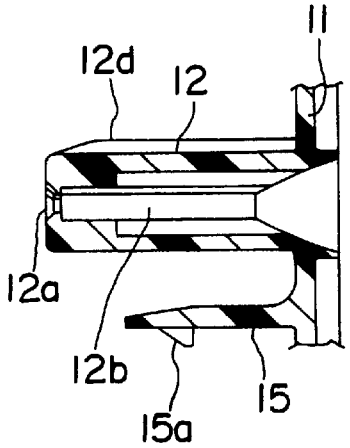
Figure 1B:
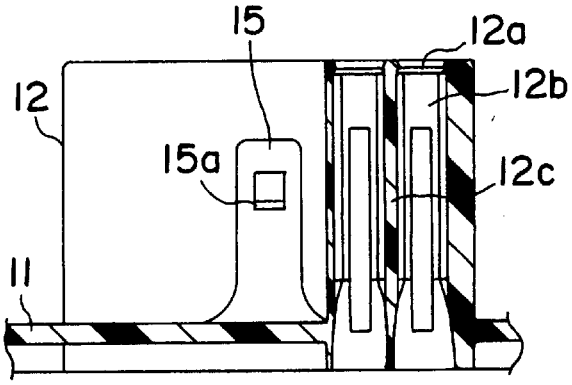
Figure 3:
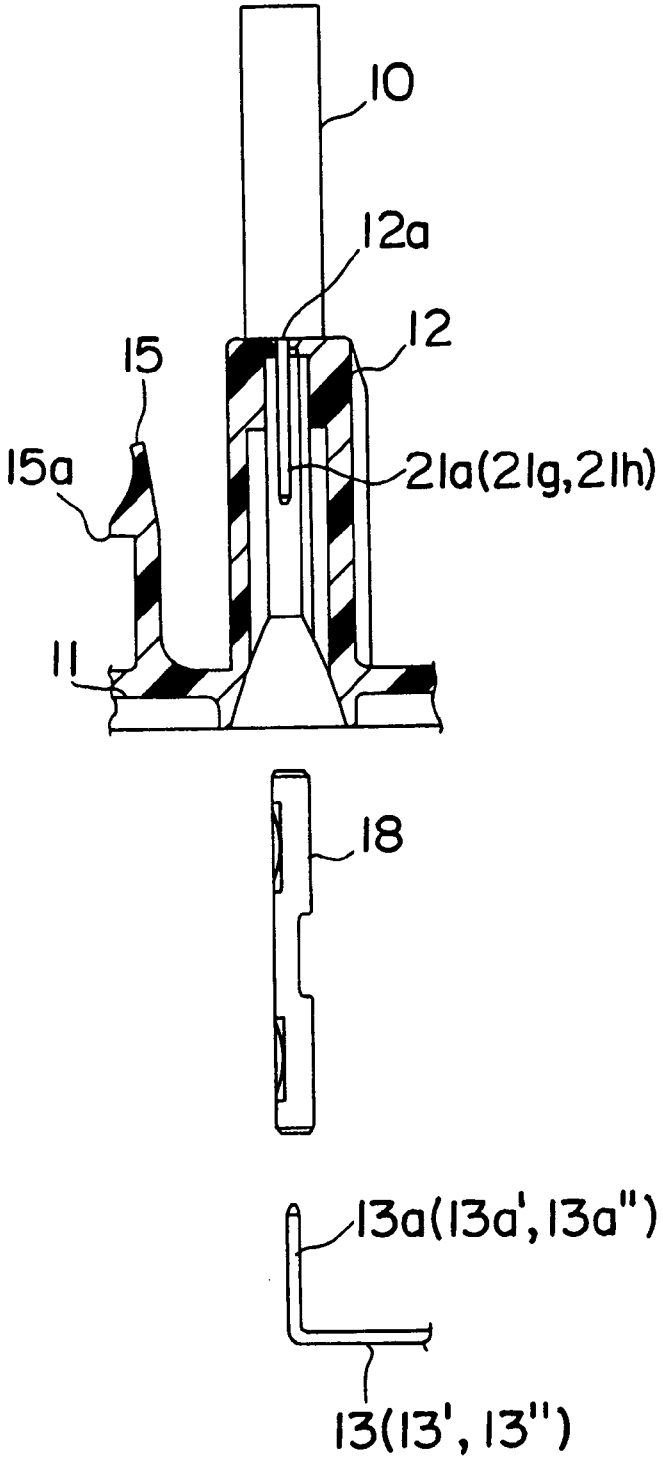
FIG. 3 is a diagram showing the integrated fuse mounted on a common mount portion of the junction box.
Figure 4A:
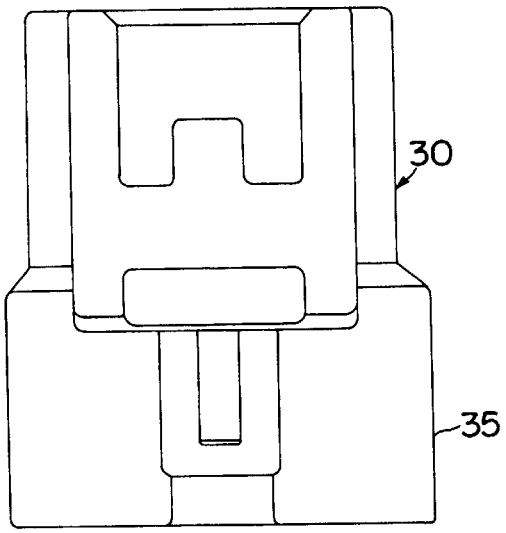

As shown in FIGS. 1(A), 1(B) and 1(C), a common mount portion 12 for parts projects from an upper casing 11 of a junction box. On the common mount portion 12, an integrated fuse 10 shown in FIG. 2 and a wire connecting connector 30 shown in FIG. 4 can be selectively mounted as shown in FIG. 3 and as shown in FIG. 5, respectively.

Figure 2A:
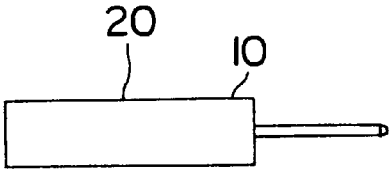
Figure 2B:
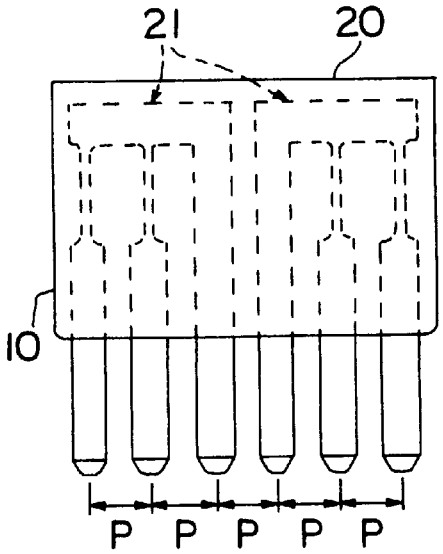
Figure 2C:
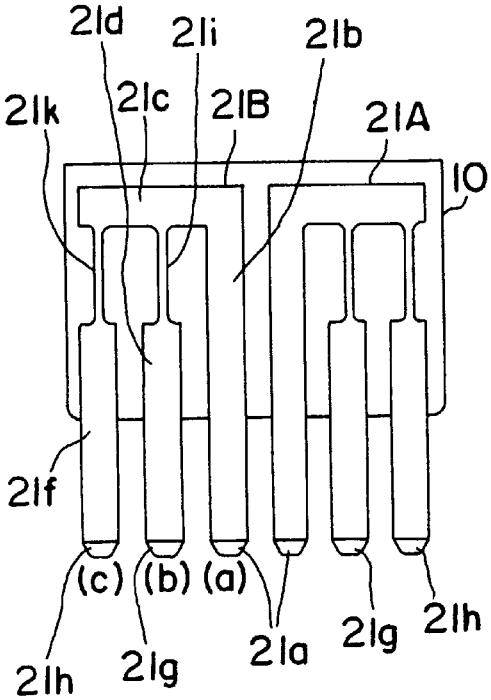

The integrated fuse 10 is constructed as shown in FIGS. 2(A), 2(B) and 2(C). Two conductors 21 (21A, 21B) are accommodated in a casing 20 made of an insulating resin. Each conductor 21 has e.g. three teeth as shown in FIGS. 2(A) and 2(B). A tab 21*a* to be connected e.g. with a power source is provided at the leading end of one tooth (a). A bent or distributing portion 21*c* extends at an angle different from 0° and 180°, preferably at substantially right angles from the leading end of an extended portion 21*b* of the tab 21*a*. Two teeth (b), (c) are branched from the bent portion 21*c*. Tabs 21*g*, 21*h* to be connected, e.g. with loads, are provided at the leading ends of these branched portions 21*d*, 21*f*, and narrow fusible portions 21*i*, 21*k* are provided in intermediate portions of the branched portions 21*d*, 21*f*.

The tabs 21*a*, 21*g*, 21*h* project from the lower surface of the casing 20 at specified intervals or pitches P, and the conductors 21A, 21B accommodated in the casing 20 are preferably arranged such that the power source connection tabs 21*a* are next to each other in the middle of the casing 20 and the load connection tabs 21*g*, 21*h* follow in this order toward the outside. These six tabs project preferably substantially side by side at substantially equal intervals P from a side surface, preferably the lower surface of the casing 20.

The common mount portion 12 which is provided on the junction box is a rectangular projection formed on the upper surface of the upper casing 11. Six tab insertion openings 12*a* are formed in the upper surface of the common mount portion 12 at the substantially same intervals P as or corresponding to the tabs 21*a*, 21*g*, 21*h* projecting from the lower surface of the casing 20 of the integrated fuse 10. The inside of the common mount portion 12 is partitioned by partition walls 12*c* to form e.g. six terminal receptacles 12*b* which communicate with the respective tab insertion openings 12*a* and preferably have an open lower surface.

At the side of the common mount portion 12, a lock portion 15 preferably projects from the upper surface of the upper casing 11. A lock claw 15*a* is provided at the leading end of the lock portion 15 to lock the connector 30. Shake preventing projections 12*d* are formed on an outer surface of the common mount portion 12 substantially opposite to the side thereof toward the lock portion 15.

Figure 6A:
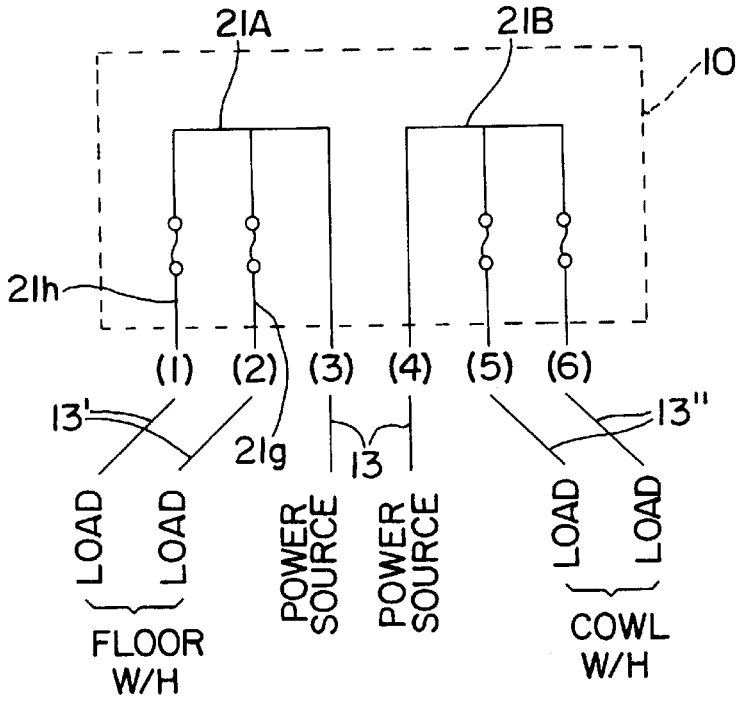
FIGS. 6(A) and 6(B) are schematic circuit diagrams showing a case where the integrated fuse is mounted and a case where the wire connecting connector is mounted, respectively.
Figure 6B:
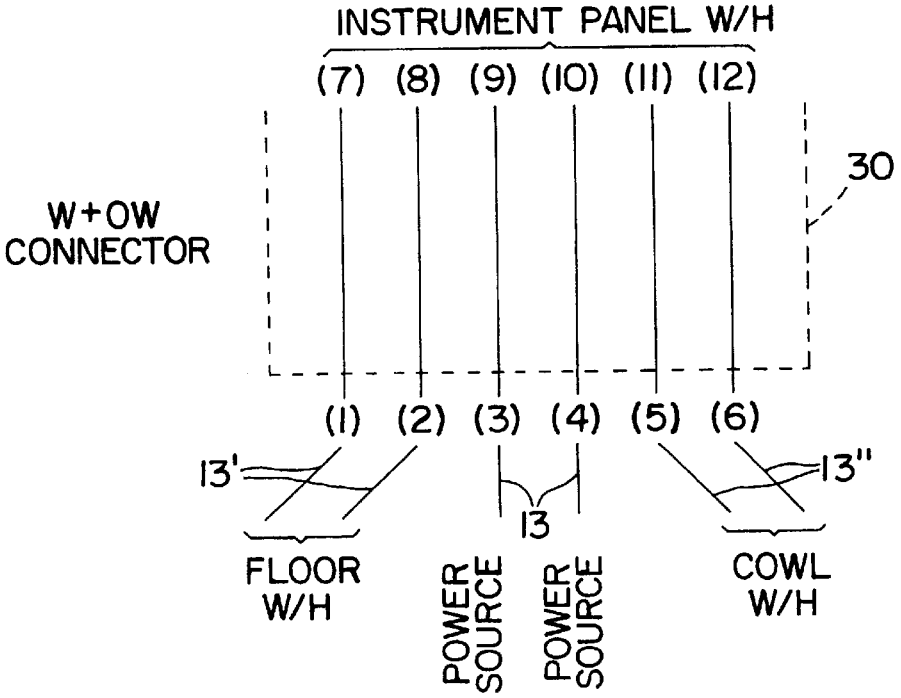

An intermediate terminal 18 is inserted into each terminal receptacle 12*b*, and a tab 13*a* provided in or on a busbar 13 substantially accommodated in the junction box is inserted into the intermediate terminal 18 through its bottom end opening to be electrically connected with the intermediate terminal 18. During this time, as shown in FIGS. 6(A) and 6(B), tabs 13*a* of the busbar 13 connected with the power source are inserted into the two middle terminal receptacles 12*b*, whereas tabs 13*a*' of a busbar 13' connected with loads, e.g. via a floor harness are inserted into the two left side terminal receptacles 12*b*. Further, tabs 13*a*" of a busbar 13" connected with loads, e.g. via a cowl harness are inserted into the two right side terminal receptacles 12*b*.

Figure 4B:
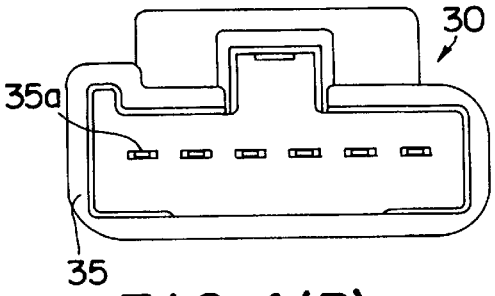
Figure 4C:
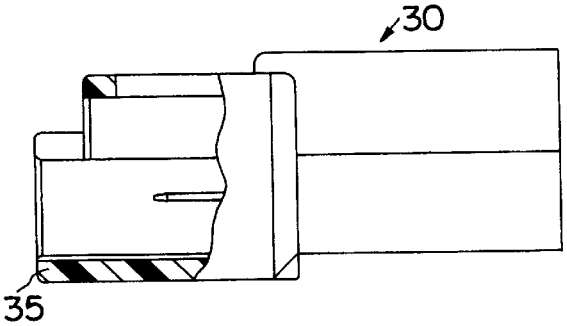
Figure 5:
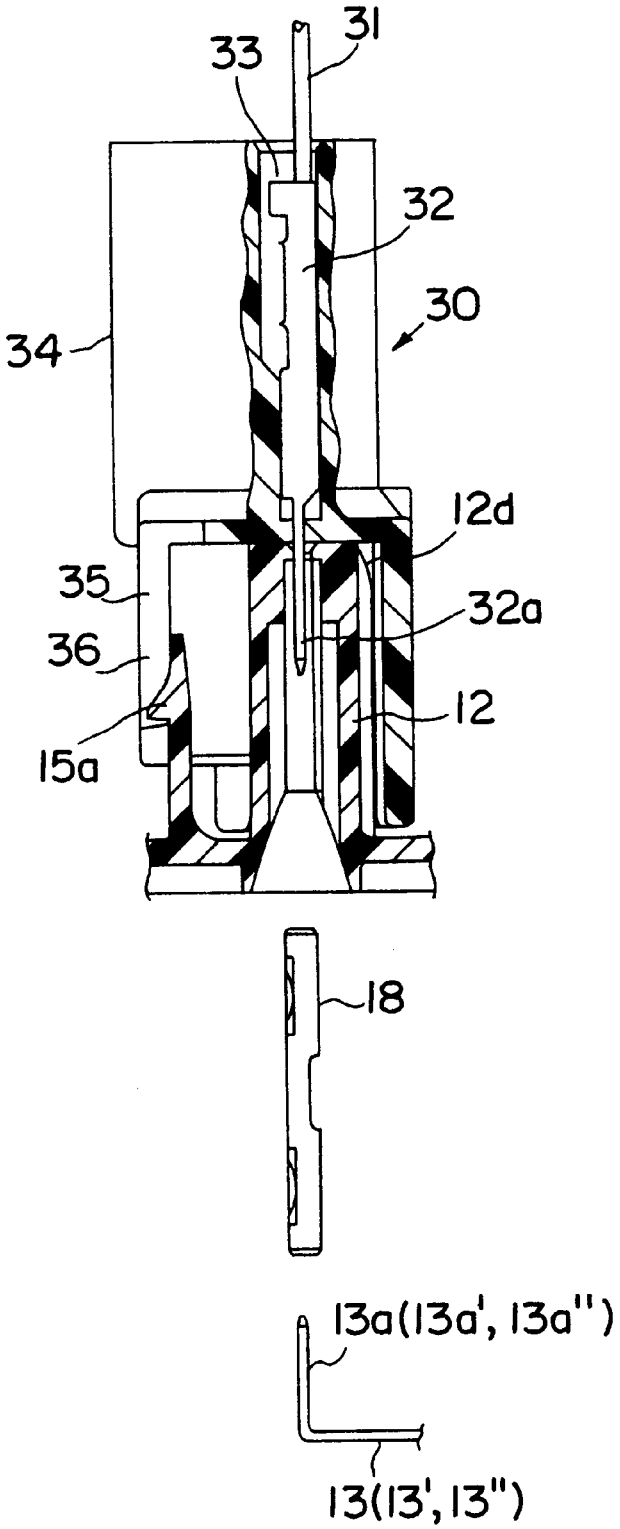
FIG. 5 is a diagram showing the wire connecting connector mounted on the common mount portion.

The wire connecting connector 30 put on the common mount portion 12 is such that an engaging portion 35 having an open lower surface as shown in FIG. 4(B) is provided at the leading end of a portion 34 where terminal receptacles 33 for accommodating terminals 32 connected with ends of wires 31 are formed, as shown in FIG. 5. A lock hole 36 is formed in a part of the peripheral wall of the engaging portion 35. The connector 30 is fixed by putting the engaging portion 35 on the common mount portion 12 and engaging the lock claw 15*a* with the lock hole 36 of the engaging portion 35. While the engaging portion 35 is put on the common mount portion 12, the shake preventing projections 12*d* come into pressing contact with the inner surface of the engaging portion 35, so that the connector 30 does not shake or undergo tilting or wedging.

The connector 30 is formed with e.g. six terminal receptacles 33. The terminals inserted into the respective terminal receptacles 33 are male terminals, and tabs 32*a* at the leading ends of the respective terminals 32 project through holes 35*a* formed in the bottom wall of the engaging portion 35 at substantially the same intervals as the tabs 21*a*, 21*g*, 21*h* of the integrated fuse 10. These tabs 32*a* have the same shape as the tabs 21*a*, 21*g*, 21*h* of the integrated fuse 10.

Figure 7:
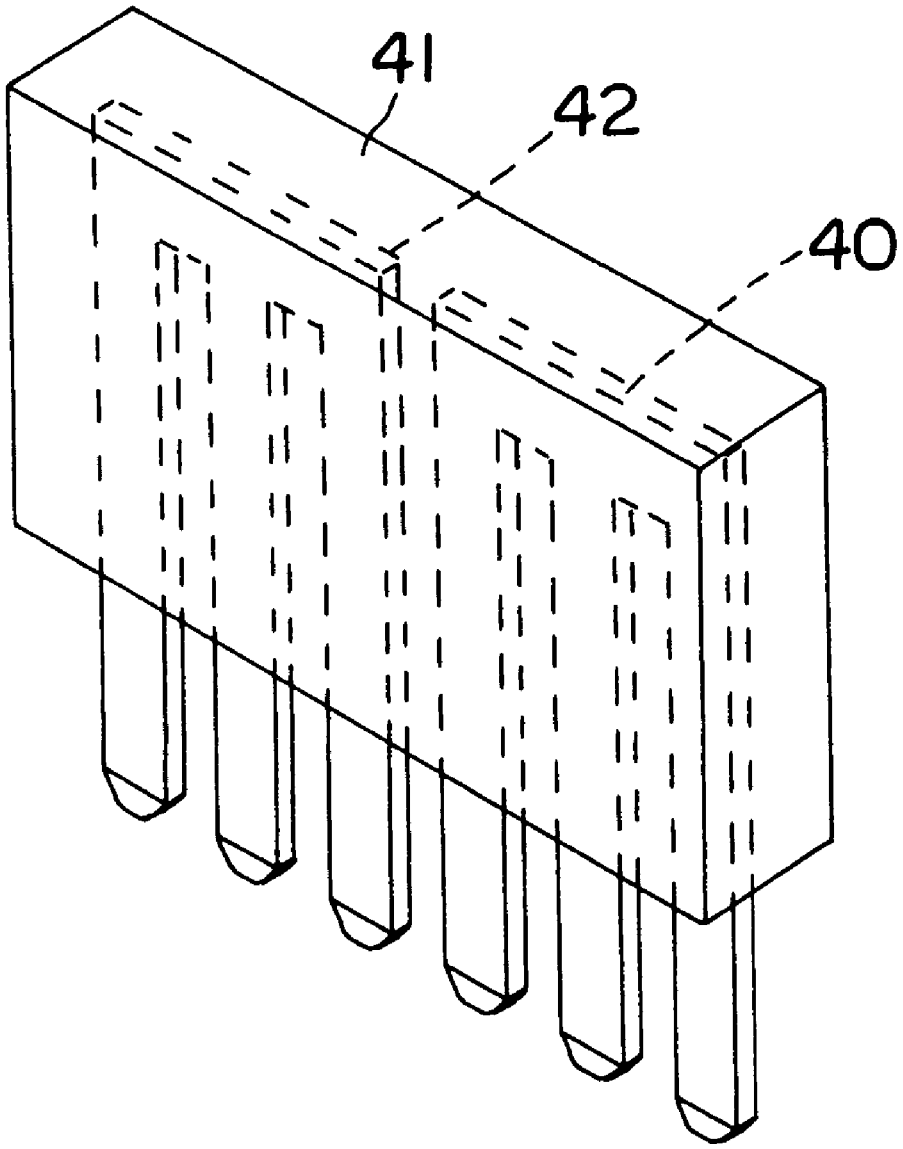
FIG. 7 is a perspective view of a short-circuiting pin assembly selectively used as a part.

Though unillustrated, a diode is also provided with e.g. six tabs having substantially the same or similar shape and projecting at the substantially same intervals as the tabs of the integrated fuse 10. Further, as shown in FIG. 7, a short-circuiting pin assembly 40 is also provided with e.g. six tabs 42 having substantially the same shape and projecting substantially at the same intervals as the tabs of the integrated fuse 10.

In the junction box as constructed above, in conformity with a circuit design, the integrated fuse 10 can be mounted on the common mount portion 12 as shown in FIG. 3, or the connector 30 can be mounted thereon as shown in FIG. 5, or the diode or short-circuiting pin assembly 40 can be mounted thereon.

In the case that the integrated fuse 10 is to be mounted as shown in FIG. 3, the tabs 21*a*, 21*g*, 21*h* of the integrated fuse 10 are inserted through the tab insertion openings of the common mount portion 12 to be connected with the intermediate terminals 18 arranged inside, and the casing 20 is placed on the upper surface of the common mount portion 12.

In the case that the integrated fuse 10 is mounted, the circuit construction of the junction box is as shown in FIG. 6(A). In particular, one of the tabs 13*a* of the busbar 13 that is connected with the power source also is connected with the tab 13*a*' of the busbar 13'. The busbar 13, in turn, is connected with the floor harness via the fusible portions. In other words, the terminals (3) and (1), (3) and (2) are connected via fuses. Further, the other of the tabs 13*a* of the busbar 13 that is connected with the power source is connected with the tabs 13*a*" of the busbar 13" that is connected with e.g. the cowl harness via the fusible portions. In other words, the terminals (4) and (5), (4) and (6) are connected via fuses.

In the case that, instead of the integrated fuse 10, the connector 30 is mounted on and locked with the common mount portion 12 as shown in FIG. 5, the circuit construction of the junction box is as shown in FIG. 6(B).

For example, the wires 31 connected with the connector 30 may construct an instrument panel harness. The cramping terminals 32 that are connected at the ends of the wires 31 are connected with the busbars 13, 13', 13" via the intermediate terminals 18 provided inside the common mount portion 12. The middle terminals (9), (10) of the instrument panel harness are connected with the terminals (3), (4) connected with the power source. The left side terminals (7), (8) thereof are connected with the terminals (1), (2) connected e.g. with the floor harness. Finally, the right side terminals (11), (12) thereof are connected with the terminals (5), (6) e.g. of the cowl harness.

As described above, the construction in which the power source side circuits and the load side circuits are connected via the internal circuits of the junction box and the integrated fuse can be adopted to distributively connect the internal circuits of the junction box with the external wiring harnesses via the connector 30.

As is clear from the above description, in the inventive electrical connection box comprised of a junction box, since the mount portion for the part is made commonly usable so that the integrated fuse, the wire connecting connector and the diode can be selectively mounted, a part in conformity with a circuit design change can be mounted thereon. Accordingly, unused part mount portion(s) can be eliminated in the junction box, contributing to a more effective use of the internal circuits of the junction box.

Further, since the wire connecting connector can be mounted instead of the integrated fuse, it needs not be mounted outside the junction box.

Figure 8:
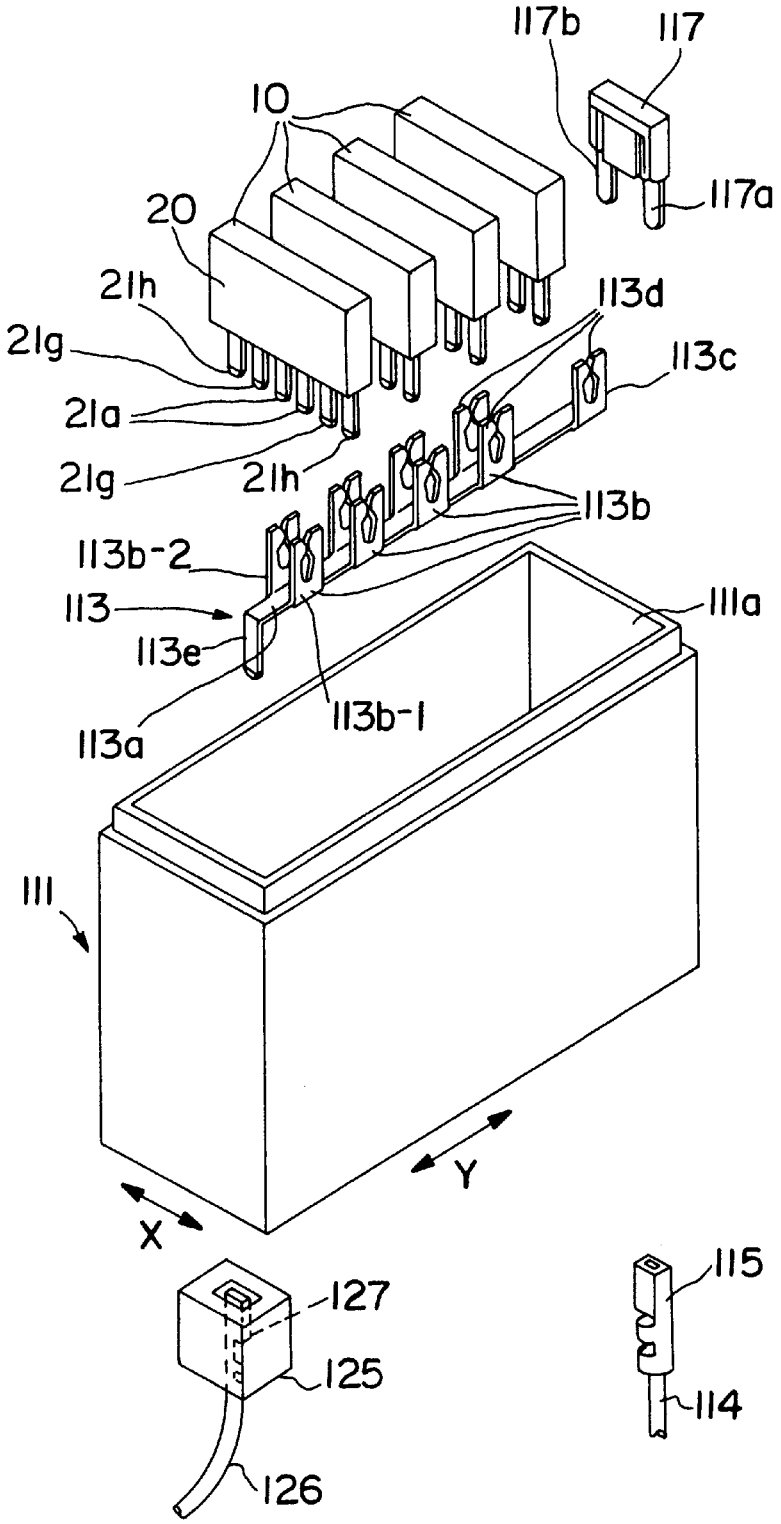
FIG. 8 is an exploded perspective view of a fuse box according to a second embodiment of the invention.
Figure 9A:
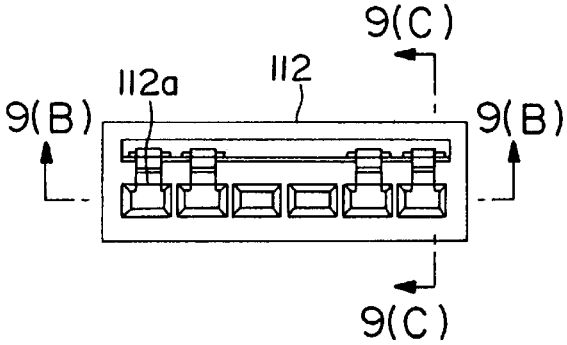
FIG. 9(A) is a plan view of an integrated fuse mount portion provided in the box of the second embodiment.
Figure 9C:
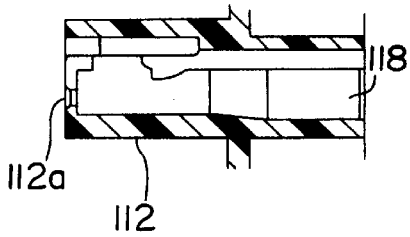
FIG. 9(B) is a section along 9(B)—9(B) of FIG. 9(A) and FIG. 9(C) is a section along 9(C)—9(C) of FIG. 9(A).
Figure 9B:
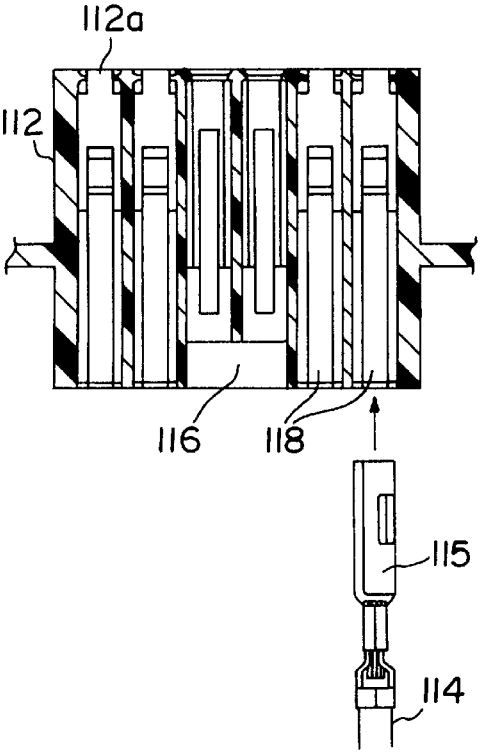
Figure 10:
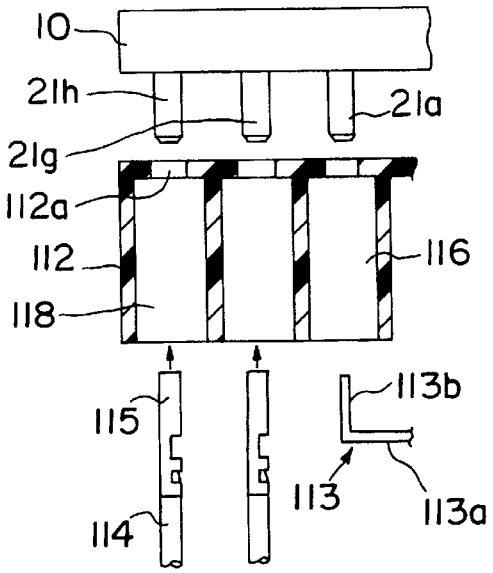
FIG. 10 is a partially schematic section of the second embodiment.

FIGS. 8 to 10 show an electrical connection box according to a second embodiment which is comprised of a fuse box specially provided for integrated fuses in which integrated fuses 10 are mainly accommodated in a box 111. The box 111 has an opening 111*a* in its upper surface. Inside the opening 111*a*, integrated fuse mount portions 112 (shown in FIG. 9) extending substantially along X-direction of FIG. 8 are arranged at specified intervals substantially along Y-direction which is perpendicular to X-direction. Tab insertion openings 112*a* are formed at specified intervals in the upper surface of each of the arranged integrated fuse mount portions 112. Further, a retainer 116 for accommodating and retaining one busbar 113 connected e.g. with a power source circuit and retainers 118 into which terminals 115 mounted on ends of wires 114 connected with loads are inserted and retained are provided preferably in a lower portion of each integrated fuse mount portion 112.

The integrated fuse 10 is constructed same or similar to that of the first embodiment, as described with reference to FIGS. 2(A) to 2(C).

Four of the above integrated fuses 10 are accommodated at specified intervals along Y-direction in the box 111. One blade fuse 117 is or may be also accommodated in the box 111.

The busbar 113 accommodated and retained in the box 111 includes, as shown in FIG. 8, a narrow base plate 113*a* and pairs of cramping tabs 113*b* (13*b*-1, 113*b*-2) which are bent to extend substantially from the opposite sides of the base plate 113*a* and arranged at specified intervals along the length of the base plate 113*a*. At one end of the base plate 113*a* is provided one cramping tab 113*c* to be connected with a tab 117*a* of the blade fuse 117.

The cramping tabs 113*b*, 113*c* each are formed with a groove 113*d* extending from a leading end thereof. The busbar 113 is accommodated in the box 111 such that the base plate 113*a* extends substantially horizontally and the cramping tabs 113*b* extend at an angle different from 0° or 180°, preferably substantially normal thereto, e.g. upward. Two downwardly extending middle tabs 21*a* of the integrated fuses 10 to be inserted into the box 111 are positioned such that the surfaces thereof substantially orthogonally intersect with those of the cramping tabs 113*b* of the busbar 113. An electrical connection is established by pressing or inserting or fitting the power source connection tabs 21*a* into the grooves 113*d* of the cramping tabs 113*b* of the busbar 113.

The other end of the busbar 113 is bent downward to form a tab 113*e* to be connected with the power source. On the other hand, the box 111 is formed such that a connector 125 is fittable from a direction other than the insertion direction of the fuses, in particular substantially opposed thereto, e.g. from below. A female cramping terminal 127 connected with an end of a wire 126 connected with the power source is accommodated in the connector 125, and the power source connection tab 113*e* of the busbar 113 is connected with the cramping terminal 127.

On the other hand, the female terminals 115 are connected with the ends of the wires 114 which, in turn, are connected with the loads. The female terminals 115 are inserted and locked in the retainers 118 of the box 111, and the load connection tabs 21*g*, 21*h* of the integrated fuse 10 and a load connection tab 117*b* of the blade fuse 117 are fitted into the retainers 118 from above for connection with the female terminals 115.

In the electrical connection box comprised of the fuse box constructed as above, the pair of cramping tabs 113*b* which are opposed to each other with respect to the narrow base plate 113*a* of one busbar 113 connected with the power source are brought into direct contact with the two power source connection tabs 21*a* of the corresponding integrated fuse 10, and these tabs 21*a* are branched into the load connection tabs 21*g*, 21*h* via the fusible portions 21*i*, 21*k*. Accordingly, the wires 114 connected with these load connection tabs 21*g*, 21*k* are connected with the individual fuses having divided power source side circuits. In other words, one integrated fuse 10 is equivalent to four fuses having divided power source side circuits. Thus, if four integrated fuses 10 are accommodated as shown in FIG. 8, there are provided a total of 16 fuses which are connected with the loads, respectively. Further, since the blade fuse 117 is separately accommodated in the box 111, a total of 17 fuses are arranged in the fuse box 111.

Thus, in the fuse box accommodating a multitude of integrated fuses 10, since a multitude of fuses having divided power source side circuits are efficiently accommodated in a small box, the fuses can be fractionized without taking up a large space.

If the fuses are set to have a small amount of permissible current by suitably setting the fusible portions 21*k*, 21*i* of the load connection tabs 21*g*, 21*h*, wires connected with the loads are allowed to have a small diameter, thereby preventing a wiring harness assembled by bundling the wires from becoming larger.

Figure 11:
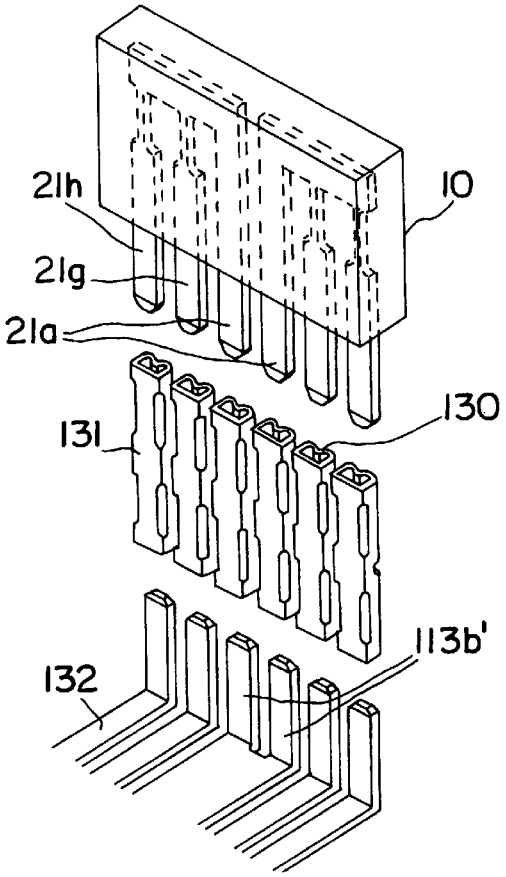
FIG. 11 is a perspective view of a third embodiment.

Although the power source connection tabs 21*a* of the integrated fuses 10 are directly connected with the cramping tabs 113*b* of the busbar 113 in the second embodiment, the busbar 113 may have tabs 113*b*' in the form of a flat plate which are to be connected with the tabs 21*a* via intermediate terminals 130 as shown in a third embodiment of FIG. 11. Further, the load connection tabs 21*g*, 21*h* may also be connected with a load side circuit formed by a busbar 132 via intermediate terminals 30.

Figure 12:
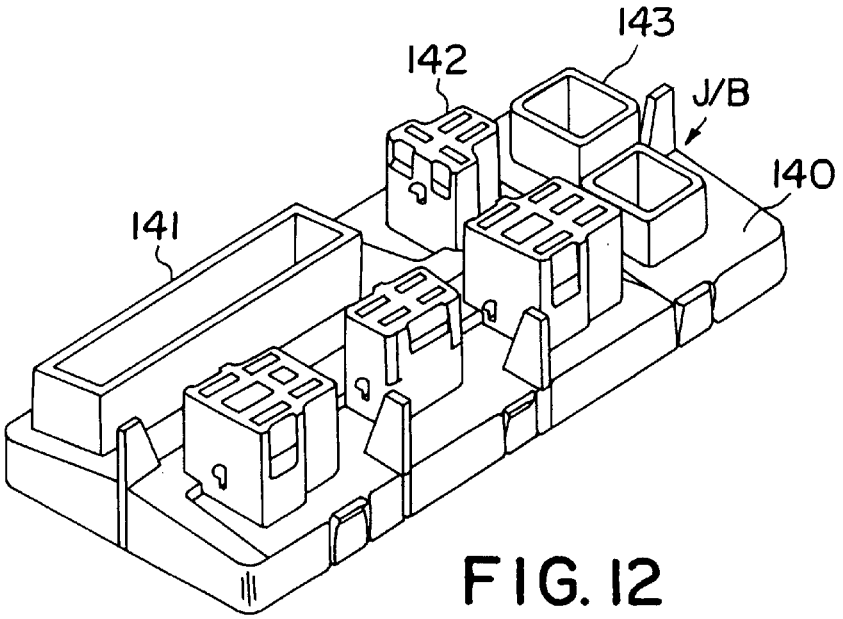
FIG. 12 is a perspective view of a fourth embodiment.

FIG. 12 shows a fourth embodiment. Although the electrical connection box of the second embodiment is comprised of the fuse box, a mount portion 141 in which a plurality of integrated fuses are densely arranged may be provided in a part of an upper casing 140 of a junction box J/B as in the fourth embodiment. Besides the integrated fuse mount portion 141, the upper casing 140 also is provided with relay mount portions 142, connector receptacles 143 and the like.

As described above, in the case of the junction box on which the fuses, relays, connectors and other parts are mixedly mounted in a highly compact manner, a multitude of integrated fuses are densely arranged adjacent to each other. Accordingly, the fuses can be arranged while being fractionized or distributed to different circuits, without taking up a large space.

Figure 13:
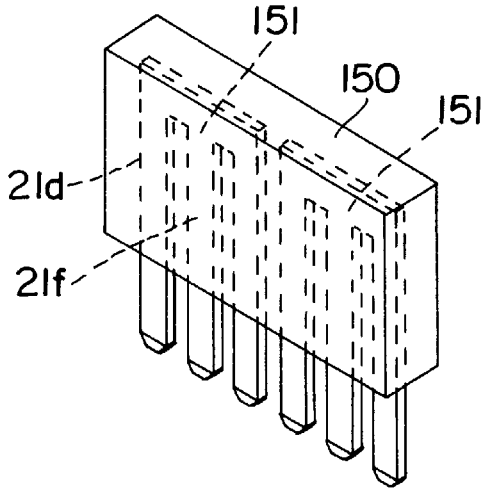
FIG. 13 is a perspective view of a short-circuiting pin assembly used in a fifth embodiment.

FIG. 13 shows a short-circuiting pin assembly 150 having the same outer configuration as the integrated fuse 10 which is used in a fifth embodiment. A part of a multitude of integrated fuses 10 to be arranged in the electrical connection box are replaced by the short-circuiting pin assemblies 150. Although the fuses are constructed by forming the narrow fusible portions in the load side branched portions of the conductors 21 of the integrated fuse 10, load side branched portions 21*d*, 21*f* of conductors 151 forming short-circuiting pins are not formed with the fusible portions. The other construction of the conductors 151 is same or similar as those of the integrated fuse 10.

Since the short-circuiting pin assembly 150 has substantially the same outer configuration as the integrated fuse, it can be connected with the power source side circuit and the load side circuits by being mounted on the integrated fuse mount portion. Thus, in the case that the circuit is desired to be fractionized without using the fuses, the short-circuiting pin assembly 150 easily can fulfill such an object, enhancing a degree of freedom of a circuit design change.

Figure 14:
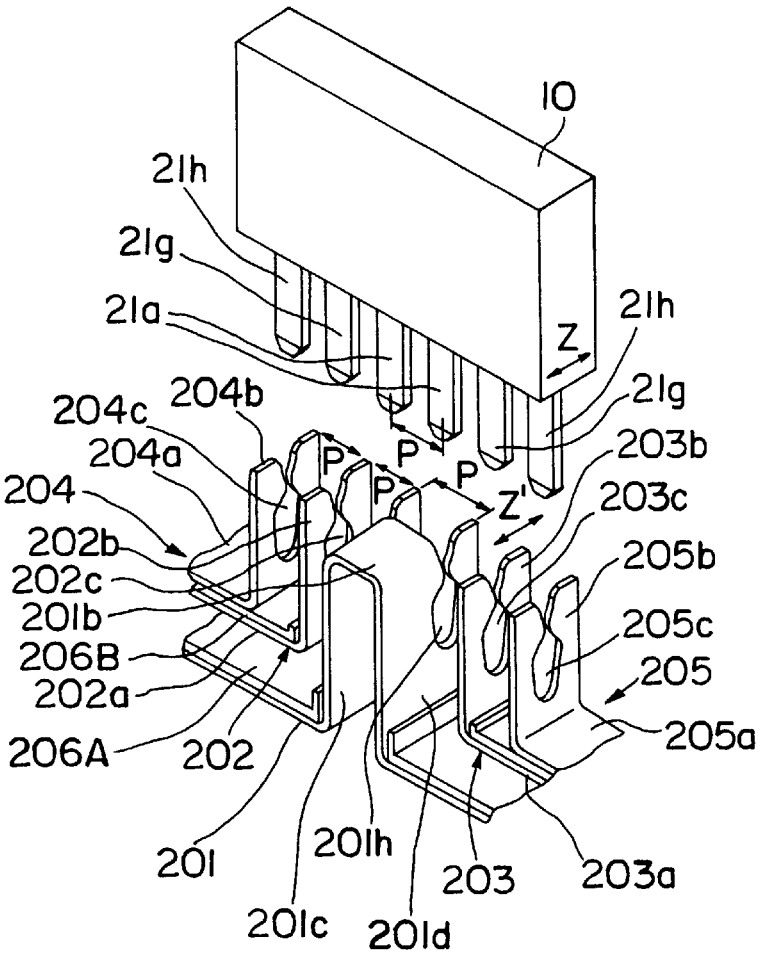
FIG. 14 is an exploded perspective view of a sixth embodiment of the invention.

As shown in FIG. 14, tabs 21*a*, 21*g*, 21*h* projecting at specified preferably substantially equal intervals or pitches P from the lower surface of a casing 20 of an integrated fuse 10 to be mounted on an electrical connection box are to be connected with busbars 201, 202, 203, 204, 205 accommodated in the electrical connection box.

The integrated fuse 10 of this embodiment is constructed the same as or similar to that of the first embodiment, as described with reference to FIGS. 2(A) to 2(C).

Figure 15:
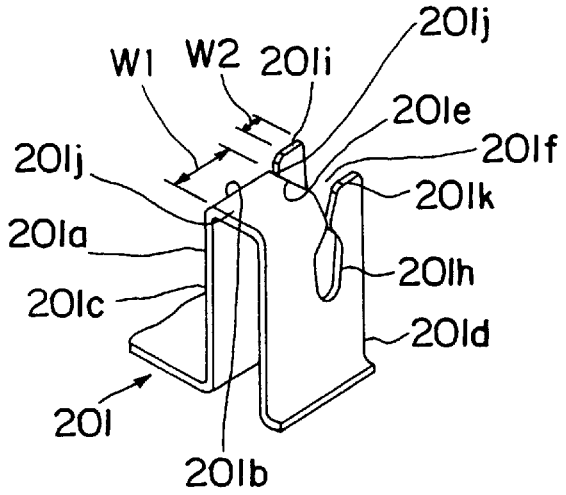
FIG. 15 is an enlarged view of an essential portion of FIG. 14.

The busbar 201 to be brought into contact with the power source connection tabs 21*a*, 21*a* of the same circuit in the middle of the integrated fuse 10 is bent to form an upwardly projecting preferably U-shaped bent portion 201*a* in a position corresponding to the tabs 21*a* as shown in FIG. 15. A transverse groove 201*e* extending substantially between vertical side walls 201*c* and 201*d* is formed in a horizontal leading end wall 201*b* of the bent portion 201*a*. In the vertical side walls 201*c*, 201*d* are formed a pair of press grooves 201*g*, 201*h* which extend from the opposite ends of the groove 201*e*. A spacing between the press grooves 201*g*, 201*h* formed in the vertical side walls 201*c*, 201*d* is substantially same as the interval P between the tabs 21*a*, so that the tabs 21*a* can be pressed into the press grooves 201*f*, 201*g* from above to be electrically connected.

Further, one side of the transverse groove 201*e* is cut away to form an opening 201*f* in the horizontal leading end wall or connecting wall portion 201*b* of the bent portion 201*a*. Accordingly, upper ends 201*i*, 201*k* of the press grooves 201*g*, 201*h* of the vertical side walls 201*c*, 201*d* at the one side are not connected by the horizontal leading end wall so as to be movable or elastically deflectable or deformable.

A width w1 of a remaining portion 201*j* of the horizontal leading end wall 201*b* which connect the vertical side walls 201*c*, 201*d* at the other side of the groove 201*e* is larger than a width w2 of the cut-away portion or the portion of the bent portion 201*a* between the vertical side walls 201*c*, 201*d* not being connected by the horizontal connecting wall portion or leading end wall 201*b* or remaining portion 201*j*.

Base portions 202*a*, 203*a* of the busbars 202, 203 are placed on the upper surfaces of the opposite sides of base portions of the busbar 201 to be connected with a power source via insulating plates 206A, respectively. The leading ends of the base portions 202*a*, 203*a* are bent to form tabs 202*b*, 203*b* having press grooves 202*c*, 203*c*, respectively. The tabs 202*b*, 203*b* are arranged substantially in parallel with the vertical side walls 201*c*, 201*d* of the busbar 201 while being spaced apart therefrom preferably by a distance P.

Further, base portions 204*a*, 205*a* of the busbars 204, 205 are placed on the upper surfaces of the base portions 202*a*, 203*a* of the busbars 202, 203 via insulating plates 206B, respectively. The leading ends of the base portions 204*a*, 205*a* are bent to form tabs 204*b*, 205*b* having press grooves 204*c*, 205*c*, respectively. The tabs 204*b*, 205*b* are arranged substantially in parallel with the vertical side walls 201*c*, 201*d* of the busbar 201 and the tabs 202*b*, 203*b* while being spaced apart from the tabs 202*b*, 203*b* preferably by a distance or pitch P.

In this way, the busbars 202, 203 are placed on the upper surfaces of the opposite sides of the busbar 201 accommodated in the electrical connection box via the insulating plates 206A, and the busbars 204, 205 are placed on the upper surfaces of the busbars 202, 203, via the insulating plates 206B; so that the tabs 202*b*, 204*b* and the tabs 203*b*, 205*b* are arranged at specified intervals at the opposite sides of the bent portion 201*a* in the middle of the busbar 201.

Figure 16A:
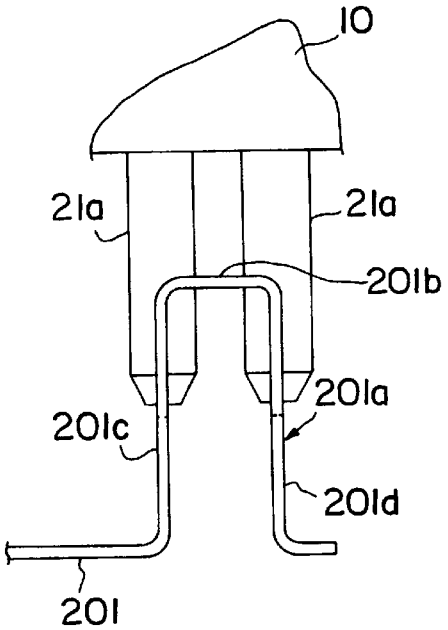
FIGS. 16(A) and 16(B) are a front view and a side view showing the connection of tabs with a busbar.
Figure 16B:
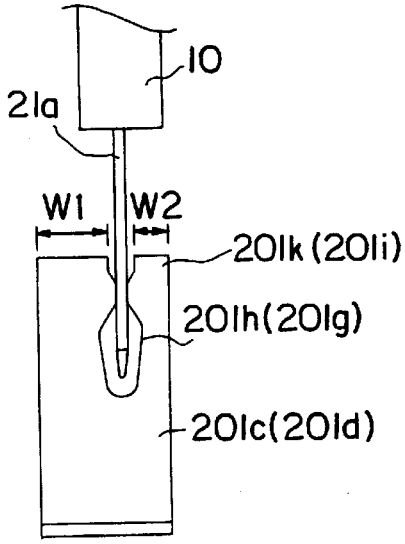

If the integrated fuse 10 is mounted on the electrical connection box accommodating the busbars 201–205 as described above to insert the tabs 21*a*, 21*g*, 21*h*, the power source connection tabs 21*a* in the middle of the integrated fuse 10 are pressed into the press grooves 201*g*, 201*h* of the vertical side walls 201*c*, 201*d* of the bent portion 201*a* of the busbar 201 as shown in FIGS. 16(A) and 16(B).

At this time, if the tabs 21*a* of the integrated fuse 10 are displaced or deformed along thickness direction Z of FIG. 14, and/or if there is an error in the thickness of the tabs 21*a*, since the upper ends 201*i*, 201*k* at the one side of the press grooves 201*g*, 201*h* are movable in arrow directions Z', the end surfaces of the press grooves 201*g*, 201*h* at the movable side come into contact with the tabs 21*a*. As a result, even in such cases, no contact failure occurs.

Further, since the other sides of the press grooves 201*g*, 201*h* are unmovably connected by the leading end wall 201*b* and the width w1 of this connected portion is larger than the width w2 of the unconnected portion, the press grooves 201*g*, 201*h* are not easily deformable, thereby hindering an undesirable event where the press grooves 201*g*, 201*h* are opened to such an extent as to cause a contact failure with the tabs 21*a*.

The load connection tabs 21*g*, 21*h* at the opposite sides of the integrated fuse 10 are connected with the tabs 202*b* to 205*b* of the busbars 202, 203, 204, 205 at the opposite sides in a similar manner.

Figure 17:
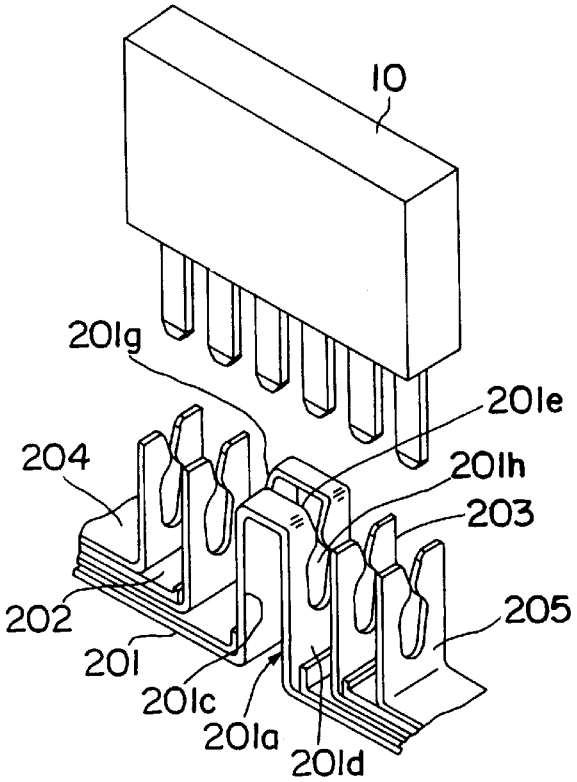
FIG. 17 is an exploded perspective view of a seventh embodiment.

FIG. 17 shows a seventh embodiment. The construction of the seventh embodiment is similar to that of the sixth embodiment in that the transverse groove 201*e* is formed in the center of the horizontal side wall 201*b* of the bent portion 201*a* of the busbar 201 to be connected with the power source and the press grooves 201*g*, 201*h* continuous with the opposite ends of the groove 201*e* are formed in the vertical side walls 201*c*, 201*d*. However the vertical side walls 201*c*, 201*d* are connected at the opposite sides of the groove 201*e* without cutting away one side of the leading end wall 201*b* with respect to the groove 201*e*.

With the above configuration, the tabs 21*a* of the integrated fuse 10 can be pressed into the press grooves 201*g*, 201*h* at the opposite sides of the bent portion 201*a* to establish an electrical connection, and the press grooves 201*g*, 201*h* can be securely brought into contact with the tabs 21*a* by making a degree of deformation smaller.

Although the integrated fuse is connected with the busbars provided in the electrical connection box without using intermediate terminals in the foregoing embodiments, a similar connection can be made without using intermediate terminals even when a short-circuiting pin assembly 40 shown in FIG. 7 is mounted on the electrical connection box instead of the integrated fuse. In other words, if tabs projecting from a casing 41 of the short-circuiting pin assembly 40 are of the same shape and project corresponding to or at substantially the same intervals as the tabs of the integrated fuse 10, they can be selectively connected with the busbars.

FIGS. 18 to 21 show a first embodiment according to a second aspect of the invention, in which e.g. six tabs 21*a*, 21*g*, 21*h* project at specified preferably substantially equal intervals P from the lower surface of a casing 20 of an integrated fuse 10 to be mounted on a junction box. The tabs 21*a*, 21*g*, 21*h* are connected via intermediate terminals 306, 307, 308, 309, 311 with tabs 301*a* to 305*a* formed on busbars 301 to 305 to be accommodated in the junction box by bending.

The integrated fuse 10 is constructed same or similar to that of the first embodiment of the invention, as described with respect to FIGS. 2(A) to 2(C).

Figure 18:
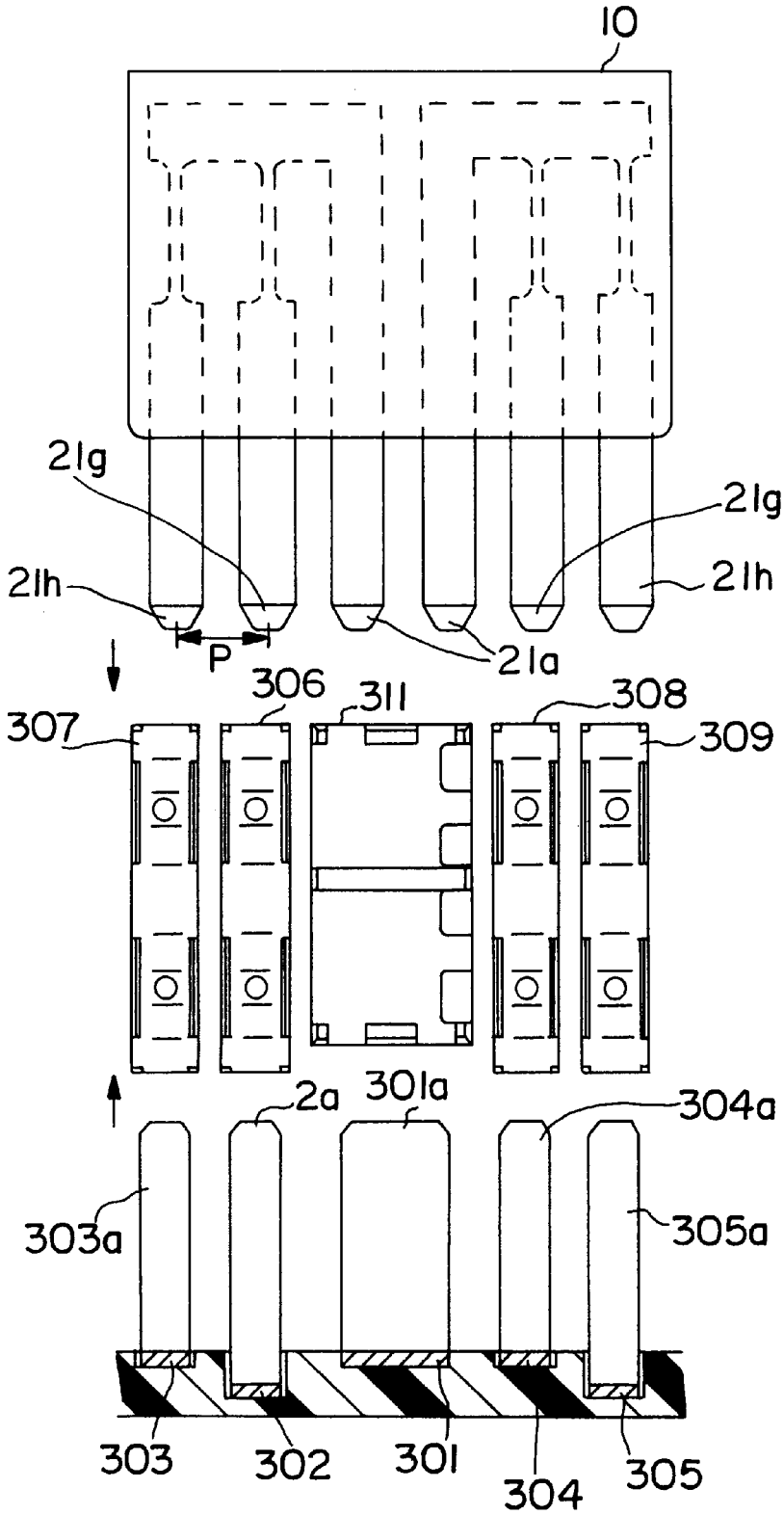
FIG. 18 is a schematic diagram of a first embodiment of a second aspect of the invention.
Figure 19A:
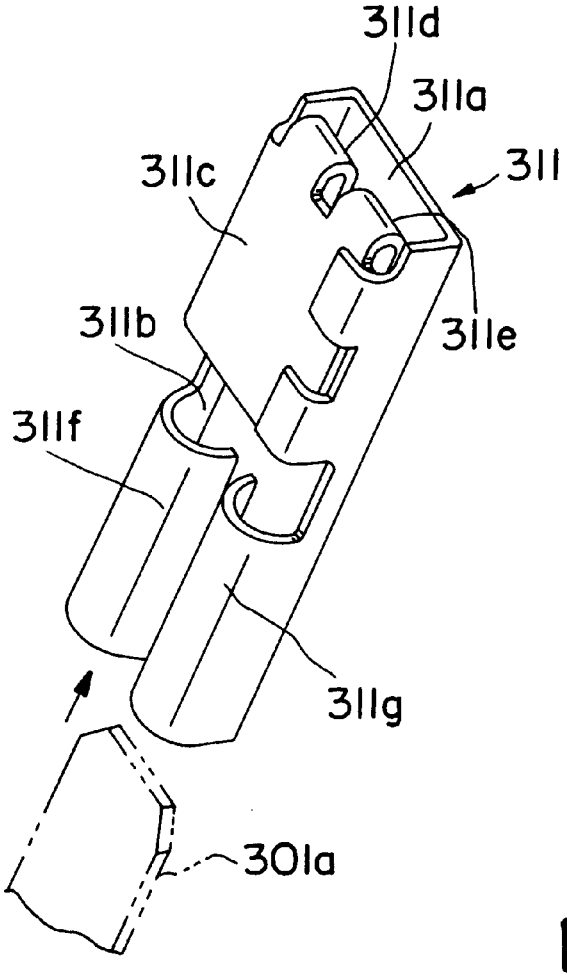
Figure 19B:
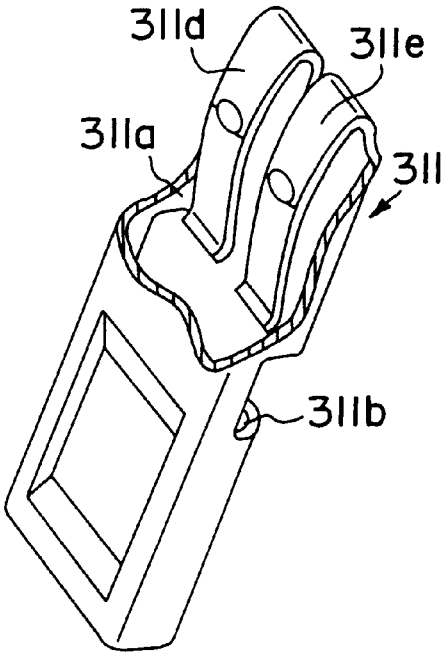
Figure 20A:
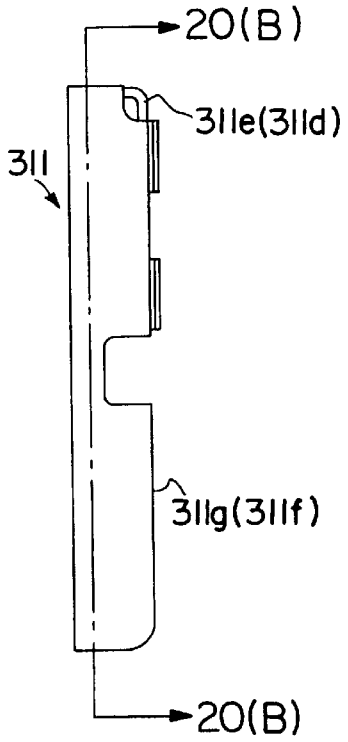
FIG. 20(A) is a side view of the intermediate terminal and 20(B) is a section along 20(B)—20(B) of FIG. 20(A).
Figure 20B:
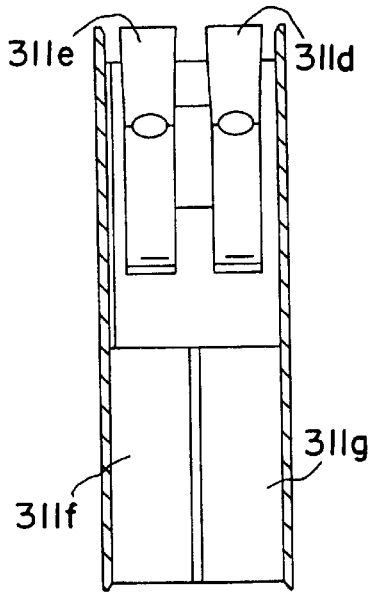

Inside the junction box, the power source connected busbar 301 to be connected with the power source connection tabs 21*a* in the substantially middle of the integrated fuse 10 is formed with an upwardly extending wide tab 301*a* by bending in a position corresponding to the tabs 21*a* as shown in FIG. 18. The busbars 302 to 305 connected with loads are arranged at the opposite sides of the busbar 301, and are formed with upwardly extending narrow tabs 302*a* to 305*a* by bending, respectively. These tabs 302*a* to 305*a* are located in positions corresponding to the tabs 21*g*, 21*h* of the integrated fuse 10.

The intermediate terminals 306 to 309, 311 for connecting the tabs 301*a* to 305*a* of the busbars 301 to 305 with the tabs 21*a*, 21*g*, 21*h* of the integrated fuse 10 are inserted into a fuse mount portion (not shown) provided inside the junction box. The intermediate terminal 311 is adapted to connect the power source connection wide tab 301*a* with the two narrow tabs 21*a* of the integrated fuse 10, and is configured as shown in FIGS. 19(A), 19(B), 20(A) and 20(B).

The intermediate terminal 311 for distributing a power from the power source is preferably formed by bending one conductive metal plate, and has preferably a substantially flat rectangular tubular shape formed with tab insertion openings 311*a*, 311*b* at its opposite ends. The upper tab insertion opening 311*a* in FIGS. 19 and 20 is used to insert two tabs of the integrated fuse 10, whereas the lower tab insertion opening 311*b* is used to insert one tab of the busbar 301.

At the side of the upper tab insertion opening 311*a*, two narrow spring pieces 311*d*, 311*e* extend from the upper end of a wide side portion 311*c* having a rectangular tubular shape which is formed by bending as shown in FIGS. 19 and 20. These spring pieces 311*d*, 311*e* are folded back inside the wide side portion 311*c* so that the two narrow tabs 21*a* inserted into the tab insertion opening 311*a* can come into pressing contact with the spring pieces 311*d*, 311*e*, and may deform or deflect the spring pieces 311*d*, 311*e* to a certain extent.

At the side of the lower tab insertion opening 311*b*, a pair of arcuately curved spring pieces 311*f*, 311*g* extend from the opposite sides of the surface of the intermediate terminal 311 where the wide side portion 311*c* is provided. When the wide tab 301*a* of the busbar 301 is inserted, the leading ends of the spring pieces 311*f*, 311*g* come into pressing contact with the tab 301*a*. In other words, the pair of spring pieces 311*f*, 311*g* form one wide spring portion.

The tabs 302*a* to 305*a* of the busbars 302 to 305 connected with the loads have substantially the same width as the narrow tabs 21*g*, 21*h* of the integrated fuse 10. The intermediate terminals 306 to 309 for connecting these tabs have preferably a hollow cylindrical or tubular shape which is narrower than the intermediate terminal 311 as shown in FIG. 18 and has or may have the same shape as prior art intermediate terminals. Tab insertion openings are provided at the opposite ends of these intermediate terminals 306 to 309. The opposite sides of each of these tab insertion openings preferably are curved arcuately to form spring portions so as to be brought into pressing contact with the tabs to be inserted.

Figure 21:
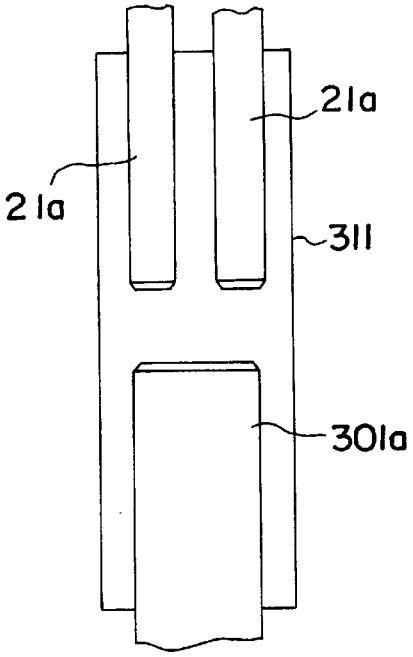
FIG. 21 is a schematic diagram showing the intermediate terminal with tabs inserted thereinto.

With the above construction, if one wide tab 301*a* of the busbar 301 is inserted into the tab insertion opening of the intermediate terminal 311 to be connected with the intermediate terminal 311 and the two narrow tabs 21*a* of the integrated fuse 10 are inserted into the other tab insertion opening 311*a* to be connected with the intermediate terminal 311 as shown in FIG. 21, the power source circuit can be divided into the power source circuits of the integrated fuse. Further, it is not necessary to provide the busbar 301, i.e. the same circuit with two separate tabs and accordingly only one intermediate terminal is needed.

Figure 22A:
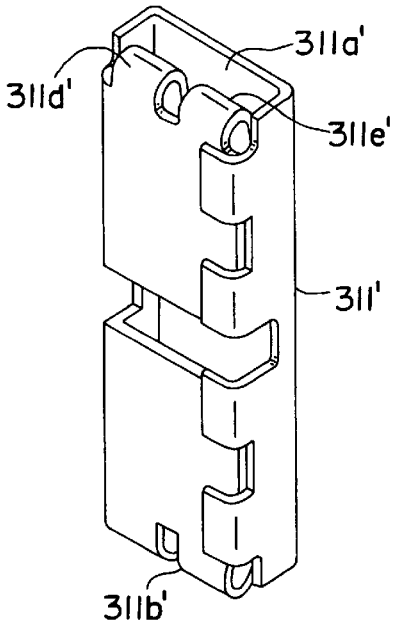
Figure 22B:
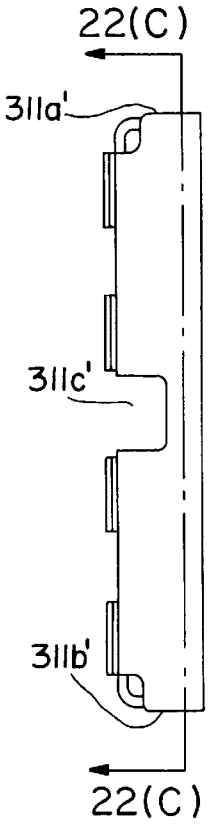
Figure 22C:
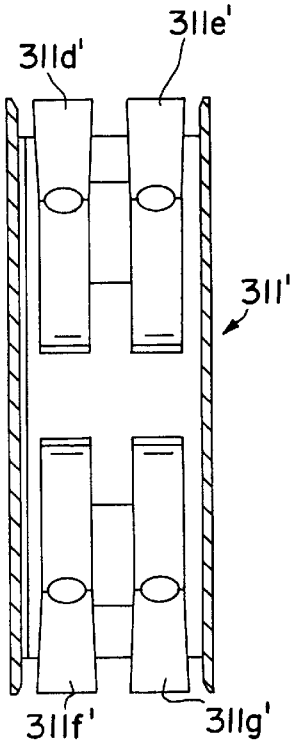
Figure 23:
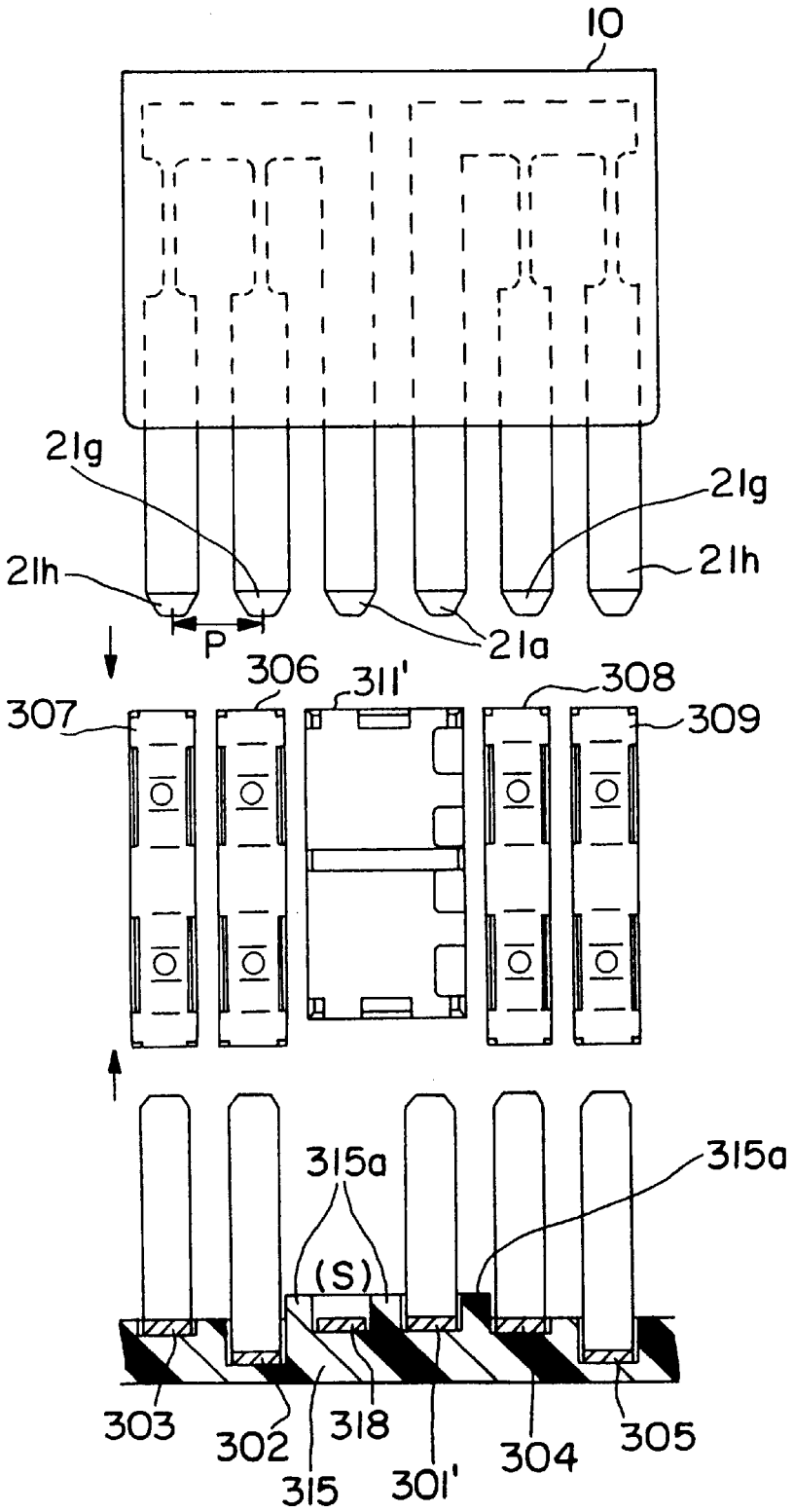
FIG. 23 is a schematic diagram showing a connection using the intermediate terminal according to the second embodiment of the second aspect of the invention.

FIGS. 22 and 23 show a second embodiment. In the description and the drawings of the second embodiment same or similar parts or elements have same or similar reference signs. In the second embodiment, an intermediate terminal 311' for connecting the tab of the busbar 301 as a power source circuit with the power source connection tabs 21*a* of the integrated fuse 10 is configured as shown in FIG. 22. Specifically, inside a tab insertion opening 311*b*' into which the tab of the busbar 301 is inserted, two narrow spring pieces 311*f*', 311*g*' are folded back from the bottom end into the tube similar to the other tab insertion opening 311*a*'.

By configuring the intermediate terminal 311' as above, when the tab 301*a* of the busbar 301 is wide as in the first embodiment, the tab 301*a* inserted into the tab insertion opening 311*b*' can be brought into pressing contact with the two narrow spring pieces 311*f*', 311*g*'. On the other hand, as shown in FIG. 23, the tab 301*a*' of the busbar 301 is as narrow as the tabs of the integrated fuse, the tab 301*a* inserted into the tab insertion opening 311*b*' can be brought into pressing contact with only one 311*f*' of the two narrow spring pieces 311*f*', 311*g*'.

By configuring the intermediate terminal 311' of the second embodiment as above, the intermediate terminal 311' can be used both in the case that a large current is distributed using the wide tab of the busbar and in the case that a small current is distributed using the narrow tab of the busbar. Further, since the tab insertion openings 311*b*' and 311*a*' have the same configuration, the intermediate terminal 311' can be more conveniently used without necessitating to pay attention to which ends should be connected with the tab of the busbar and the tab of the integrated fuse.

Further, as shown in FIG. 23, a base plate 301*b*' of the busbar 301' having the upward extending tab 301*a*' is arranged on an insulating plate 315 formed with a rib 315*a*, and the intermediate terminal 311' is arranged or arrangeable on the upper surface of the rib 315*a*.

With the above construction, an empty space (S) is defined below the intermediate terminal 311' where the tab 301*a*' does not project and is used for a different busbar 318. Accordingly, the inner space of the electrical connection box can be effectively used, enabling a high density arrangement.

Although the integrated fuse is connected with the busbars provided in the electrical connection box via the intermediate terminals in the first and second embodiments, even in the case that a short-circuiting pin assembly 40 shown in FIG. 7 is mounted on the electrical connection box instead of the integrated fuse, it is sufficient to provide the busbar with one tab and to provide one intermediate terminal for the connection with the same power source circuit, i.e. with the same busbar in a construction similar to the first and second embodiments. Further, the invention is also applicable to a case where tabs projecting from a wire connecting connector or diode instead of from the integrated fuse or short-circuiting pin assembly are connected with the busbars accommodated in the electrical connection box while distributing a power from the power source.

Although the tabs project from the busbars provided in the electrical connection box in the foregoing embodiments, in the case that internal circuits are constructed by wires and cramping terminals connected with the wires, one wide tab of the cramping terminal is used for the connection with a plurality of tabs of the integrated fuse, diode, short-circuiting pin assembly and wire connecting connector via one intermediate terminal if a large current is distributed similar to the tab of the above busbar while one narrow tab is used if a small current is distributed.

Next embodiments according to a third aspect of the invention will be described with reference to FIGS. 24 to 28.

Figure 24A:
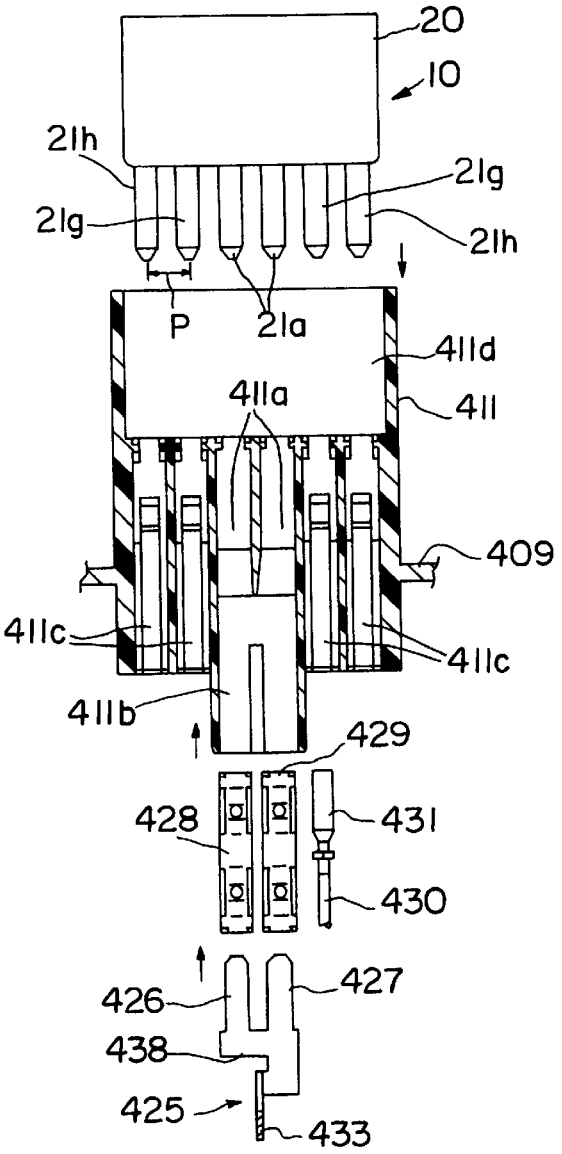
Figure 24B:
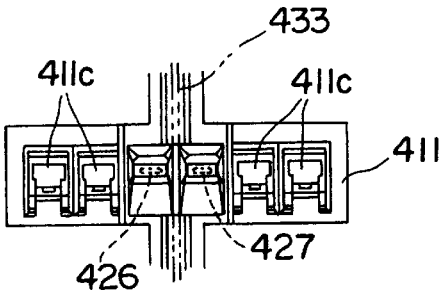
Figure 25A:
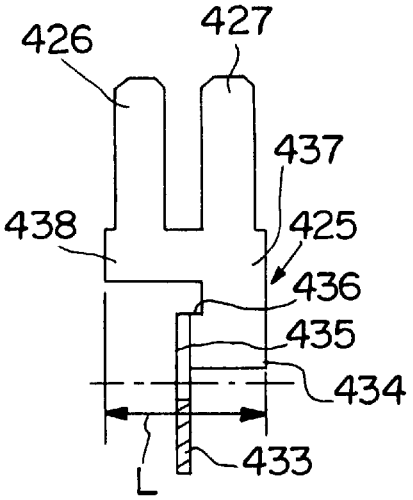
Figure 25C:
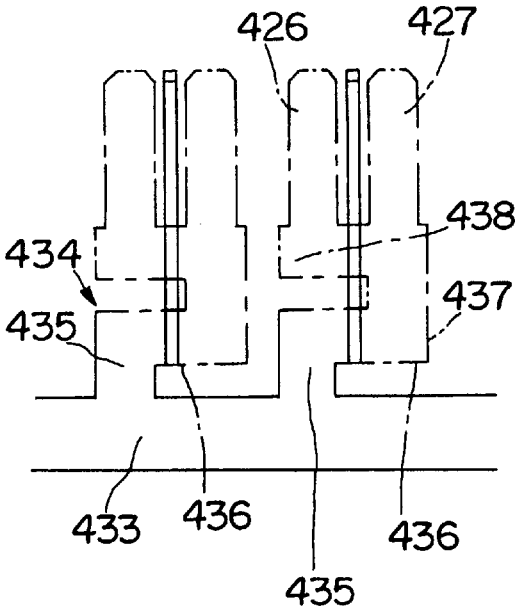
Figure 25B:
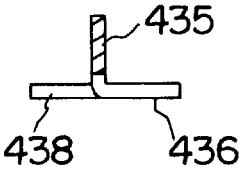
Figure 26:
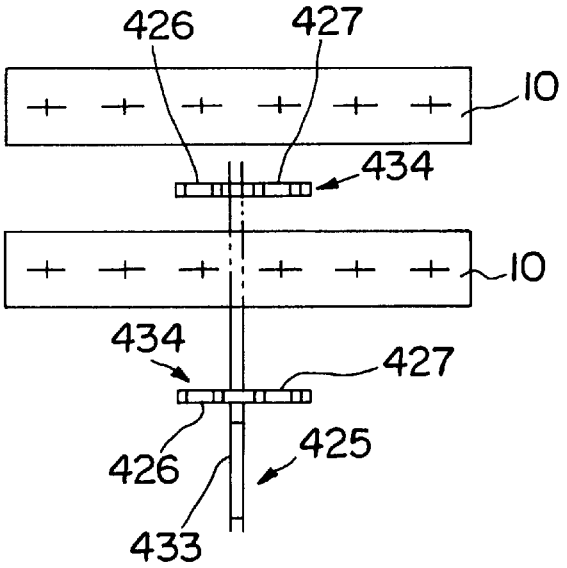
FIG. 26 is a schematic diagram showing a positional relationship of the busbar and an integrated fuse.

FIGS. 24 to 26 show a first embodiment, in which an integrated fuse 10 is fitted into a fuse receptacle 411 provided in a relay block 409 to connect preferably two middle ones 21*a* of e.g. six tabs projecting at specified preferably equal intervals or pitches P from the lower surface of a casing 20 of the integrated fuse 10 with two tabs 426, 427 of a busbar 425 accommodated in the relay block 409 via intermediate terminals 428, 429. The outer tabs 21*g*, 21*h* are connected with cramping terminals 431 mounted at ends of wires 430.

The busbar 425 is configured as shown in FIGS. 25(A) and 25(B) preferably by bending a conductive metal plate. Specifically, in a development shown by phantom line in FIG. 25(C), tab portions 434 projects from the upper end of a base plate 433 arranged in a substantially vertical direction (first direction). Each tab portion 434 includes a preferably vertical plate 435 (first plate) upwardly and continuously extending from the upper end of the base portion 433, a first preferably horizontal plate 436 (second plate) extending along the substantially horizontal direction (second direction) from the upper end of the first vertical plate 435, a second preferably vertical plate 437 (third plate) substantially upwardly extending from the leading end of the first horizontal plate 436, a second preferably horizontal plate 438 (fourth plate) extending from the upper end of the second vertical plate 437 in a direction opposite from the first horizontal plate 436, and two tabs 426, 427 projecting from the upper end of the second horizontal plate 438.

From a developed state shown by phantom line in FIG. 25(C), the leading end of the first horizontal plate 436 is bent at an angle different from 0° or 180°, preferably at substantially 90° and the first vertical plate 435 and the base plate 433 are located below an arrangement range (L) of the two tabs 426, 427 provided at the upper end of the second horizontal plate 438 as shown by solid line in FIG. 25(C).

The two tabs 426, 427 are so arranged as to be arranged at an angle different from 0° or 180°, preferably substantially perpendicular to the base plate 433, and the base plate 433 is located substantially right in the middle of the arrangement range (L) of the tabs 426, 427. As shown in FIG. 26, in the case that a plurality of integrated fuses 10 are arranged in parallel, the tab portions 434 having spaced tabs 426, 427 are so formed as to be perpendicular to the base plate 433 of the busbar 425.

The integrated fuse 10 is constructed similar or same as that described with reference to FIGS. 2(A) to 2(C).

The busbar 425 accommodated in the relay block 409 is connected with the power source. In the case that the integrated fuse 10 is mounted on the relay block 409, the tabs 426, 427 of the busbar 425 are inserted into a tab receptacle 411*a* formed in the middle of the fuse mount portion 411 while being fitted into the intermediate terminals 428, 429. At this time, the base plate 433 of the busbar 425 is located right between the tabs 426 and 427 and is accommodated in a busbar receptacle 411*b* which is continuously formed with the tab receptacle 411*a* and has preferably the substantially same width as the tab receptacle 411*a*.

Further, at the opposite sides of the tab receptacle 411*a* of the fuse mount portion 411 are formed two each of cramping terminal receptacles 411*c* into which female cramping terminals 431 mounted at the ends of the wires 430 are to be inserted.

When the integrated fuse 10 is inserted into an upper engaging portion 411*d* of the fuse mount portion 411 to fit the tabs 21*a* into the tab receptacle 411*a*, the tabs 21*a* are fitted or inserted into the intermediate terminals 428, 429 to be electrically connected with the tabs 426, 427 of the busbar 425 as a power source circuit. The tabs 21*g*, 21*h* inserted into the cramping terminal receptacles 411*c* are electrically connected with the cramping terminals 431.

Since the configuration of the busbar 425 is thus improved in order to locate the base plate 433 within the arrangement range (L) of the tabs 426, 427, the busbar 425 can be connected with the integrated fuse 10 having the tabs projecting at small intervals.

Figure 27A:
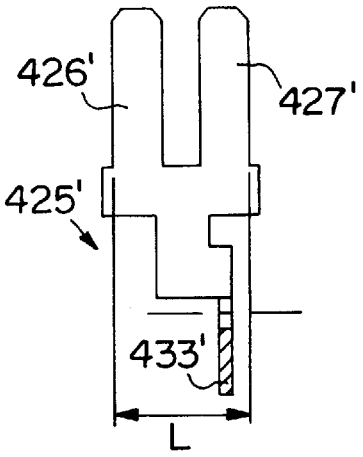
Figure 27B:
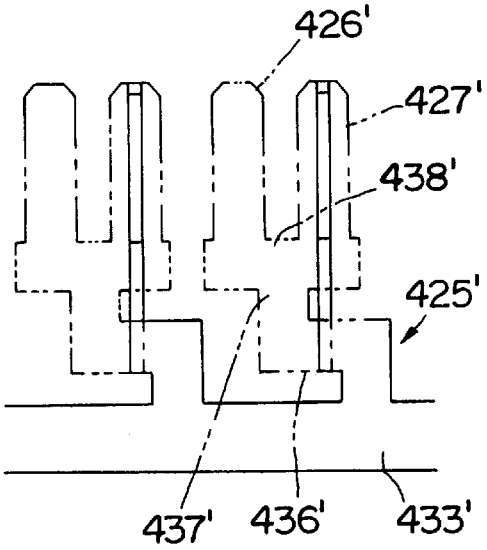

The configuration of the busbar 425 is not limited to that of the first embodiment, but may be such as in a second embodiment shown in FIGS. 27(A) and 27(B). In a busbar 425' of the second embodiment, a first horizontal plate 436' extends in a direction opposite from that of the first embodiment; a second vertical plate 437 projects from the leading end of the first horizontal plate 436'; a second horizontal plate 438' projects in opposite directions from the upper end of the second vertical plate 437', and two tabs 426', 427' project from the upper end of the second horizontal plate 438' such that the second vertical plate 437' is located therebetween. In the second embodiment as well, the first horizontal plate 436' is bent at substantially 90° so as to have a configuration as shown in FIG. 27(A).

With the above configuration, the second horizontal plate 438' from which the tabs 426', 427' project is supported not at one end thereof, but in a center portion thereof by the second vertical plate 437', the tabs 426', 427' can be stably supported. Further, the base plate 433' does not project outward by being located substantially within the arrangement range (L) of the tabs 426', 427'.

Figure 28A:
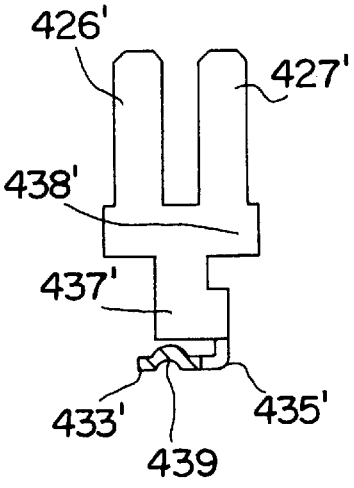
Figure 28B:
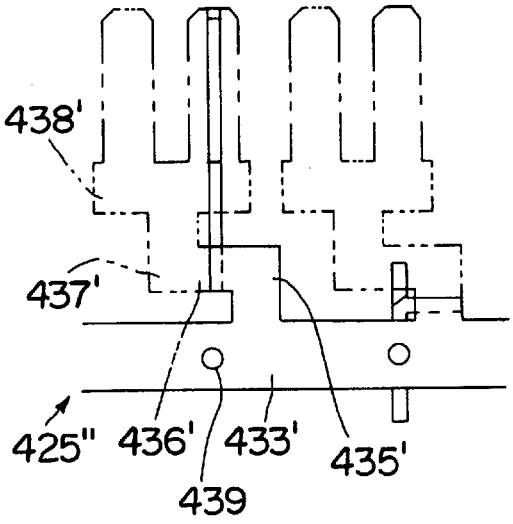
Figure 29:
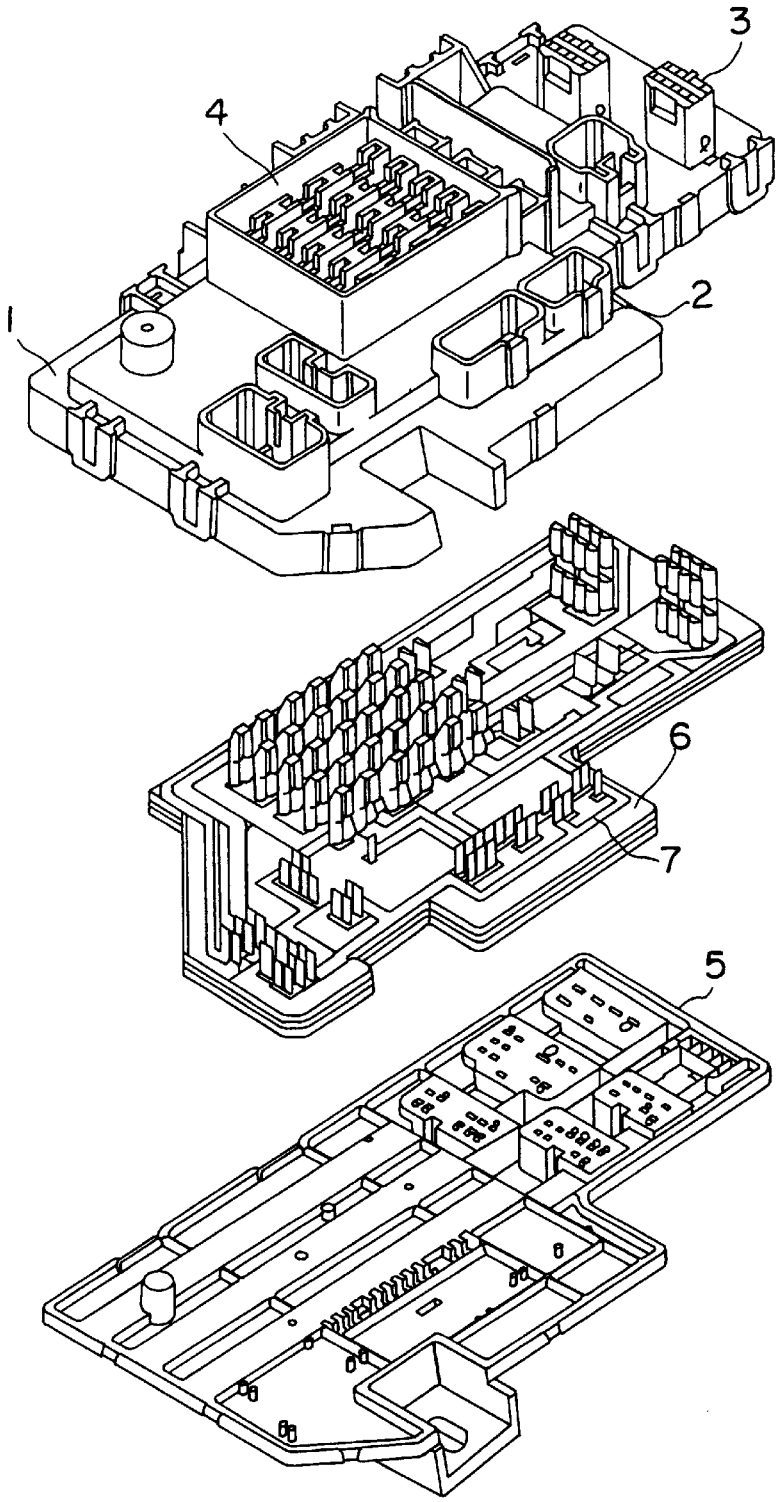
FIG.29 PRIOR ART
FIG. 29 is a perspective view of a prior art junction box.

FIGS. 28(A) and 28(B) show a busbar 425" according to a third embodiment. A developed configuration of the busbar 425" is similar to that of the second embodiment as shown by phantom line in FIG. 28(B). However, after the first horizontal plate 436 is bent at substantially 90°, the first vertical plate 435' is bent at 90° as shown at the right side of FIG. 28(B) so that the base plate 433' extends in a horizontal plane. Further, the horizontally bent base plate 433' is formed with upwardly projecting reinforcing ribs 439 preferably by embossing.

By making the base plate 433' horizontally extend, the height thereof can be reduced by as much as a bent portion. Accordingly, the thickness (height) of the second vertical plate 437' can be increased by the reduction of the height of the base plate 433', thereby enhancing the strength thereof. The strength can also be enhanced by the reinforcing ribs 439.

Although the integrated fuse is connected with the busbar provided in the relay block in the first embodiment, in the case that, instead of the integrated fuse, a short-circuiting pin assembly 40 shown in FIG. 7 is mounted on the relay block or like electrical connection box to be connected with the same busbar as a power source circuit, the connection can also be made using the busbar of the first to third embodiments. Further, the invention is also applicable to a case where tabs projecting from a wire connecting connector or diode instead of from the integrated fuse or short-circuiting pin assembly are connected with the busbars accommodated in the electrical connection box while distributing a power from the power source.

What is claimed is:

1. An electrical connection box comprised of a junction box for an automotive vehicle, on which at least two parts are mountable, said parts being selected from the group consisting of an integrated fuse, a wire connecting connector, a diode, and a short-circuiting pin assembly having tabs at equal intervals, said electrical connection box comprising a common mount portion for a selected one of the parts to be mounted, said common mount portion being formed with tab insertion openings arranged corresponding to the tabs of the part, the part being selectively mounted on the common mount portion to connect the tabs inserted through the tab insertion openings with internal circuits of the electrical connection box, the common mount portion projecting from a box of the electrical connection box and the tab insertion openings being formed substantially side-by-side in an upper surface thereof, a lock portion projecting from the box of the electrical connection box in the vicinity of the common mount portion, the lock portion having a lock claw formed thereon, and the wire connecting connector being formed with a mating lock hole engageable with the lock claw.

2. An electrical connection box according to claim 1, comprising an integrated fuse with at least one conductor, said conductor comprising one power source connection tab and at least two load connection tabs extending via fusible portions from branched portions branched from the power source connection tab, said conductor being accommodated in a casing, and wherein an integrated fuse mount portion engageable with the integrated fuse is formed on an outer surface of a box of the electrical connection box, conductors of a power source side circuit and load side circuits being provided in the electrical connection box and being connected with the power source connection tab and the load connection tabs of the integrated fuse.

3. An electrical connection box according to claim 2, wherein the power source connection tab and the load connection tabs project substantially side by side from the substantially same surface of the casing, the integrated fuse comprising at least two conductors accommodated in the casing so that at least two power source connection tabs and at least four load connection tabs project side by side from the one casing.

4. An electrical connection box according to claim 2, comprising a plurality of integrated fuse mount portions which are densely arranged adjacent to each other.

5. An electrical connection box according to claim 2, wherein the electrical connection box is comprised of a fuse box having an opening formed in its upper surface, and a plurality of integrated fuses being accommodated substantially side by side through the opening for branched connection with the conductors accommodated in the electrical connection box.

6. An electrical connection box according to claim 5, wherein the conductor accommodated in the electrical connection box is comprised of a busbar comprising fuse connection tabs which are formed by bending and formed with grooves, and the tabs of the integrated fuse are pressed into the grooves for electrical connection with the busbar.

7. An electrical connection box according to claim 5, wherein the conductor accommodated in the electrical connection box is comprised of a busbar comprising fuse connection tabs which are formed by bending and are electrically connected with the tabs of the integrated fuse via intermediate terminals.

8. An electrical connection box according to claim 7, wherein the intermediate terminal is formed by a conductive metal plate having a substantially tubular shape provided with tab insertion openings, and comprises a spring portion formed substantially inside each tab insertion opening by bending, wherein one tab is inserted or insertable into one tab insertion opening for contact with the spring portion while a plurality of tabs are inserted or insertable into the other tab insertion opening for contact with the other spring portion, so as to establish an electrical branch connection by the intermediate terminal.

9. An electrical connection box according to claim 2, wherein two conductors are accommodated in the casing of the integrated fuse such that the power source connection tabs preferably project substantially side by side substantially in a middle of the casing; a busbar being connected with a power source and being accommodated in the electrical connection box; and a pair of fuse connection tabs bent from opposite sides of a base plate of the busbar to project into electrical connection with a pair of power source connection tabs of the integrated fuse.

10. An electrical connection box according to claim 9, wherein the busbar is made of a conductive metal plate and is accommodated in an electrical connection box, and comprises a base plate arranged in a first, direction, and a tab portion projecting from an end of the base plate, the tab portion comprising:

a first plate continuously extending along the first direction from the end of the base plate, a second plate extending in a second direction arranged at an angle different from 0° and 180° with respect to the first direction and extending from the end of the first plate, a third plate extending in the first direction, preferably upwardly from the leading end of the second plate, a fourth plate substantially extending in the second direction substantially opposite from the second plate, and a plurality of tabs projecting from an end, preferably the upper end of the fourth plate, wherein the second plate, is bent at an angle different from 0° and 180° to locate the first plate and the base plate below an arrangement range of the plurality of tabs provided at the fourth plate.

11. An electrical connection box according to claim 10, wherein a plurality of pairs of fuse connection tabs substantially opposed to each other at the substantially opposite sides of the base plate of the busbar are provided at predetermined intervals along the length of the base plate so as to be connectable with the power source connection tabs of a multitude of integrated fuses arranged side by side.

12. An electrical connection box according to claims 11, wherein the busbar accommodated in the electrical connection box is provided with a power source connection tab, and a connector accommodating preferably a female terminal connected with a power source connected wire is fitted into the electrical connection box, thereby connecting the power source connection tab of the busbar with the connector, by fitting the power source connection tab of the busbar into the female terminal for the electrical connection.

13. An electrical connection box according to claim 2, wherein a short-circuiting pin assembly in which a comb-shaped short-circuiting pin is accommodated as a conductor in a casing is used instead of at least one of the multitude of integrated fuses arranged in the electrical connection box to divide a power source circuit without using fuses.

* * * * *